US006378971B1

(12) United States Patent
Tamura et al.

(10) Patent No.: US 6,378,971 B1
(45) Date of Patent: Apr. 30, 2002

(54) INK-JET RECORDING APPARATUS

(75) Inventors: Noboru Tamura; Hiroaki Tojyo; Atsushi Kobayashi; Hitotoshi Kimura; Yoshiharu Aruga; Takashi Mano, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 09/705,922

(22) Filed: Nov. 6, 2000

(30) Foreign Application Priority Data

| | | |
|---|---|---|
| Nov. 5, 1999 | (JP) | 11-315071 |
| Jan. 21, 2000 | (JP) | 2000-012461 |
| Feb. 1, 2000 | (JP) | 2000-024422 |
| Aug. 3, 2000 | (JP) | 2000-235404 |
| Sep. 29, 2000 | (JP) | 2000-299698 |
| Oct. 24, 2000 | (JP) | 2000-323963 |
| Oct. 30, 2000 | (JP) | 2000-331252 |

(51) Int. Cl.[7] ..... B41J 2/195
(52) U.S. Cl. ..... 347/7
(58) Field of Search ..... 347/7, 1, 5, 6, 347/20, 95–100, 84–94; 73/700, 708, 713

(56) References Cited

U.S. PATENT DOCUMENTS

| | | | |
|---|---|---|---|
| 5,136,309 | A | 8/1992 | Iida et al. |
| 5,956,061 | A | 9/1999 | Ahn |

FOREIGN PATENT DOCUMENTS

| | | | |
|---|---|---|---|
| EP | 0 585 560 A2 | 3/1994 | B41J/2/195 |
| JP | 62-263059 | 11/1987 | |
| JP | 3-77641 | 8/1991 | |
| JP | 4-43785 | 7/1992 | |
| JP | 10-244685 | 9/1998 | |

OTHER PUBLICATIONS

Japanese Abstract No. 11138843, dated May 25, 1999.
Japanese Abstract No. 10235899, dated Sep. 8, 1998.
Japanese Abstract No. 62152859, dated Jul. 7, 1987.
Japanese Abstract No. 11334105, dated Dec. 7, 1999.
Japanese Abstract No. 56147017, dated Nov. 14, 1981.

*Primary Examiner*—Raquel Yvette Gordon
(74) *Attorney, Agent, or Firm*—Sughrue Mion, PLLC

(57) ABSTRACT

An ink storage chamber has an indicator formed from magnetic material. A float member whose upper position is limited is housed in the ink storage chamber. Two magnetic-field detection system are provided at a position on the exterior of a sub-tank at which the detection system can detect a magnetic flux of the indicator simultaneously, such that the longitudinal direction of the detection system is oriented vertically with a specified ink level of the sub-tank sandwiched between the detection system. On the basis of signals output from the magnetic-field detection system, it is determined whether the ink level is in any one of an excessively low ink level state, a state in which injection of ink must be started, a state in which injection of ink must be stopped, and an excessively supplied state. Thus, an ink level in the sub-tank can be controlled within a specific range without involvement of an undesired increase in the number of sensors.

16 Claims, 19 Drawing Sheets

INK-JET RECORDING APPARATUS

BACKGROUND OF THE INVENTION

1. Field of the Invention

The present invention relates to an ink-jet recording apparatus comprising a carriage which performs reciprocating motion in the widthwise direction of a recording medium; an ink-jet recording head mounted on a carriage; and an ink supply system which is mounted on the carriage and supplies ink to the recording head.

2. Background Art

An ink-jet recording apparatus to be used for producing a large volume of printed matter is disclosed, for instance, in Japanese Patent Kokoku Publication No. Hei. 4-43785 and Japanese Patent Kokai Publication No. Hei. Hei. 10-44685. The apparatus disclosed in the former publication is constructed such that ink to be consumed in a printing operation is supplied to a recording head through a sub-tank, which is disposed on a carriage and connected through an ink supply tube to an ink container, such as a cassette, on a housing of the apparatus. The apparatus disclosed in the latter publication includes a sub-tank which is disposed on a carriage and supplies ink to an ink-jet recording head; an ink cartridge installed on a housing of the apparatus; and an ink replenishing unit which is connected through a conduit to the ink cartridge and removably connected to the sub-tank so that the sub-tank is intermittently replenished with a desired amount of ink.

Precise flow control is required to supply ink from the ink replenish unit to the sub-tank of a relatively small capacity without causing ink leakage, and thus a complicated valve mechanism is required.

For this reason, as disclosed in Japanese Utility Model Kokai Publication No. Hei. 3-77641 and Japanese Patent Kokai Publication No. Sho. 62-263059, it is conceivable to monitor liquid level of ink, i.e. an ink amount, in the tank with such an arrangement that a float member incorporating magnetic material is provided in an ink tank so as to be vertically movable along a guide, and a magnetic detection system is disposed outside the ink tank. This arrangement, however, suffers from problems in that the range where ink level can be detected is narrow, and idle time required for ink replenishment is long, resulting in lower throughput.

SUMMARY OF THE INVENTION

The present invention is preferably applicable to an ink-jet recording apparatus which has a recording head mounted on a reciprocating carriage, which receives supply of ink from an outside, and which, in turn, supplies ink to the recording head.

In a preferred embodiment, an ink storage chamber receives supply of ink from an outside, a float member is movable to follow liquid level of the ink stored in the ink storage chamber, an indicator is provided to the float member, and a plurality of detection systems provided opposite the indicator and arranged vertically. The detection systems cooperatively detect the indicator when the ink stored in the ink storage chamber is maintained within an appropriate range of volume. At least three statuses of ink level can be detected using signals from the detection systems, on the basis of which replenishment of ink is controlled.

Accordingly, the present invention is aimed at providing an ink-jet recording apparatus having a sub-tank, which detects variations in ink level over a wide range using a plurality of sensors, thereby maintaining ink at an appropriate level.

The present disclosure relates to the subject matter contained in Japanese patent application Nos.:

Hei. 11-315071 (filed on Nov. 5, 1999);

2000-012461 (filed on Jan. 21, 2000);

2000-024422 (filed on Feb. 1, 2000);

2000-235404 (filed on Aug. 3, 2000);

2000-299698 (filed on Sep. 29, 2000);

2000-323963 (filed on Oct. 24, 2000); and 2000-331252 (filed on Oct. 30, 2000), which are expressly incorporated herein by reference in their entireties.

BRIEF DESCRIPTION OF THE DRAWINGS

FIGS. 8 through 10 are perspective views showing another example of the sub-tank suitable for use with a recording apparatus according to the present invention, wherein FIG. 8 shows a box-shaped member before being sealed with a film member, FIG. 9 is an enlarged view showing the internal construction of the box-shaped member, and FIG. 10 shows the surface construction of the box-shaped member;

DESCRIPTION OF THE PREFERRED EMBODIMENTS

Figure 1:
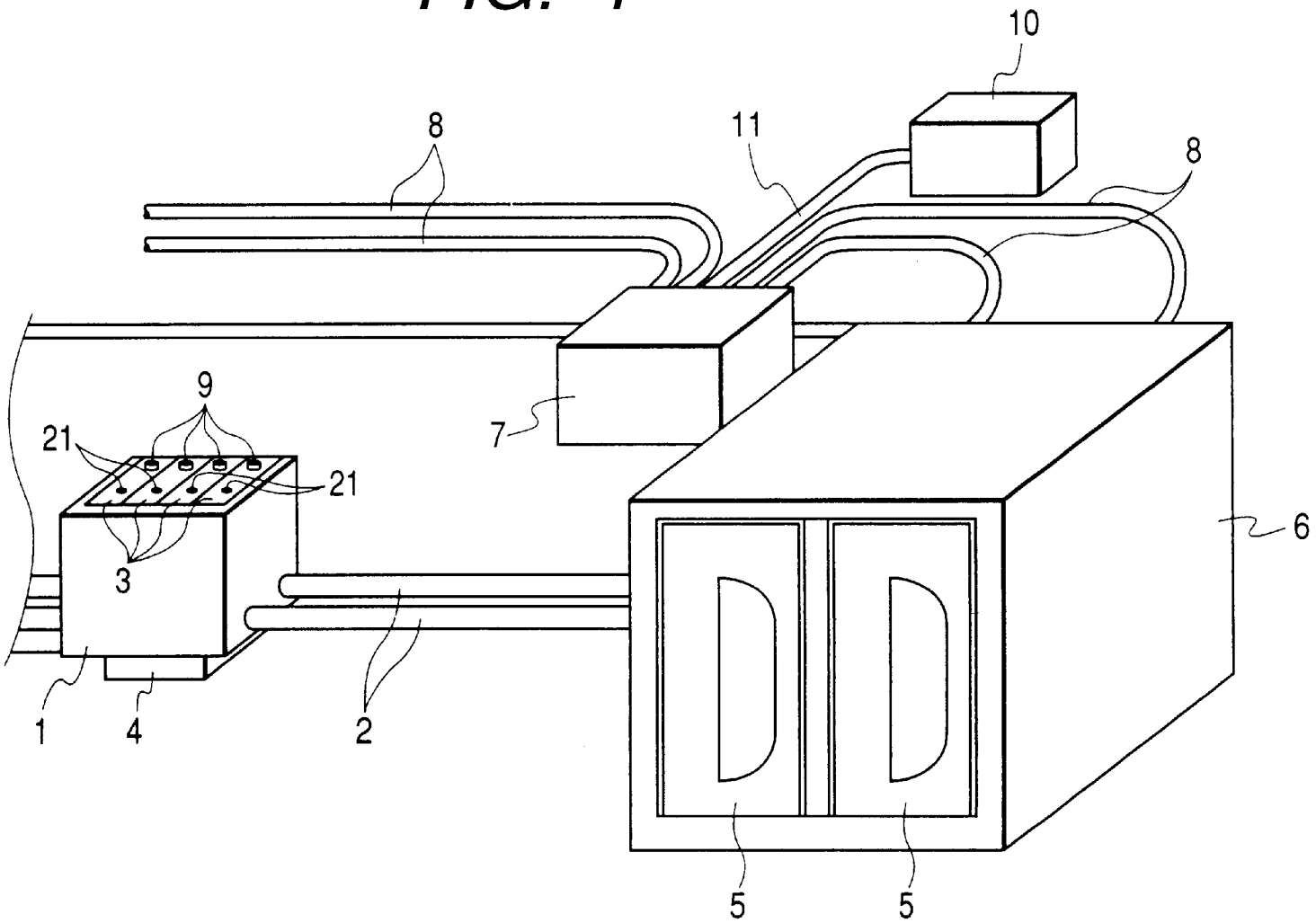
FIG. 1 is a schematic representation showing an ink supply mechanism of an ink-jet recording apparatus using a sub-tank according to an embodiment of the present invention.

FIG. 1 shows an ink-jet recording apparatus according to an embodiment of the present invention. A carriage 1 is guided by guide members 2 to be reciprocatingly movable with an unillustrated drive system. A plurality of sub-tanks 3 (four sub-tanks 3 in the present embodiment) are provided on an upper portion of the carriage 1, and a recording head 4 is provided on a lower surface thereof. A cartridge holder 6 for holding ink cartridges 5 is disposed on each end of a movable region where the carriage 1 is movable (only one of the two ends of the movable region is illustrated in FIG. 1). Further, an ink supply unit 7 is provided in a position above a non-print area of the movable region of the carriage 1.

The ink supply unit 7 is connected to the ink cartridges 5 by means of tubes 8. When the carriage 1 arrives at an ink replenishment area, the ink supply unit 7 is connected to ink inlet ports 9 formed in respective sub-tanks 3 to inject ink into the sub-tanks 3 up to a predetermined level. Reference numeral 10 designates a pump unit which serves as an ink injection pressure source and which supplies pressure to the ink replenishment unit 7 by way of a tube 11.

Figure 2:
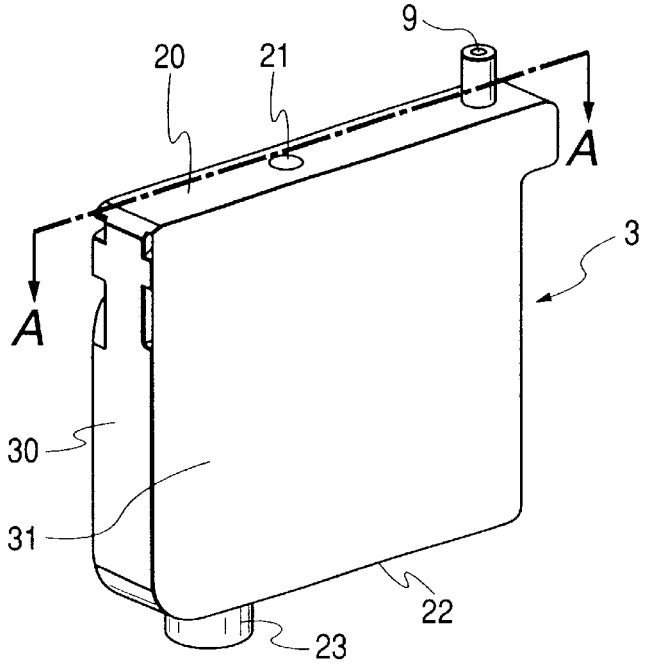
FIG. 2 is a perspective view showing an example of a sub-tank suitable for use with the ink-jet recording apparatus.

FIG. 2 shows an example of the sub-tank 3. The sub-tank 3 is formed as a flat container. The ink inlet port 9, which is communicated with an ink storage tank, and an air release port 21 are formed in an upper surface 20. An ink supply port 23 to be connected to a recording head 4 is formed in a lower portion (a lower surface 22, in this embodiment) of the sub-tank 3.

A container constituting the sub-tank 3 is substantially in the form of a frame structure molded of plastic material or the like. Open side surfaces of a casing 30 are respectively sealed by polymer films 31 and 32 provided with metal layers having considerably low gas and water-vapor permeability, so that the ink storage chamber 36 is sealed by these films 31 and 32. These films 31 and 32 preferably have such a rigidity as to be deformed due to pressure of ink.

Figure 4:
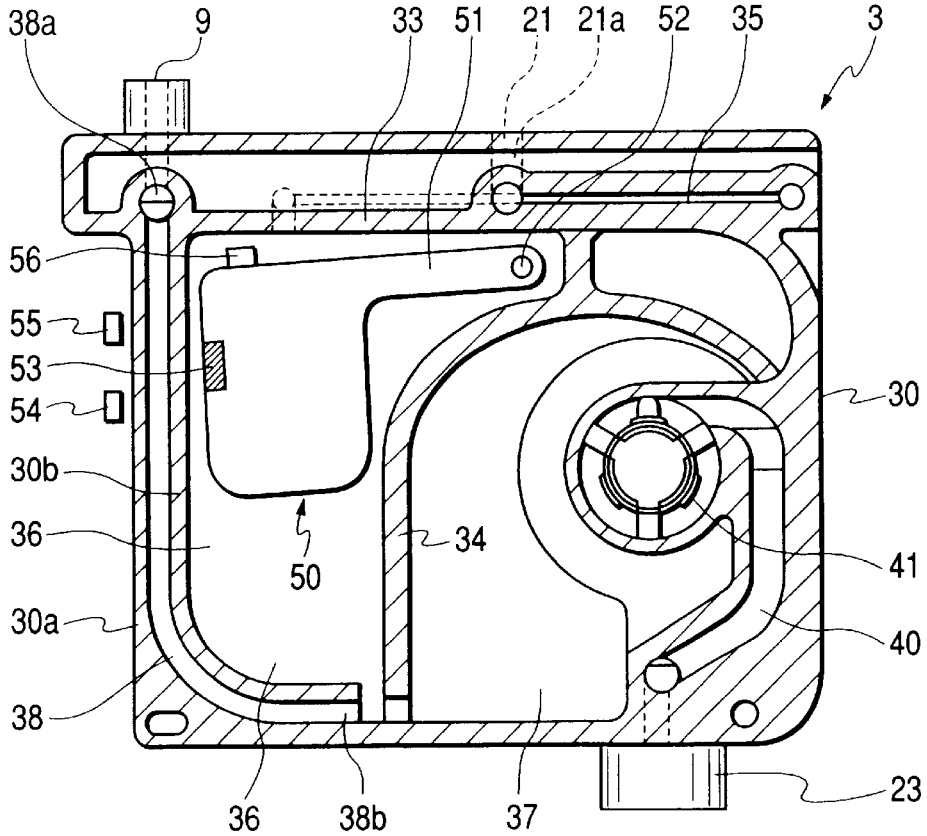
FIG. 4 is a cross-sectional view taken along line A—A shown in FIG. 2.
Figure 3A:
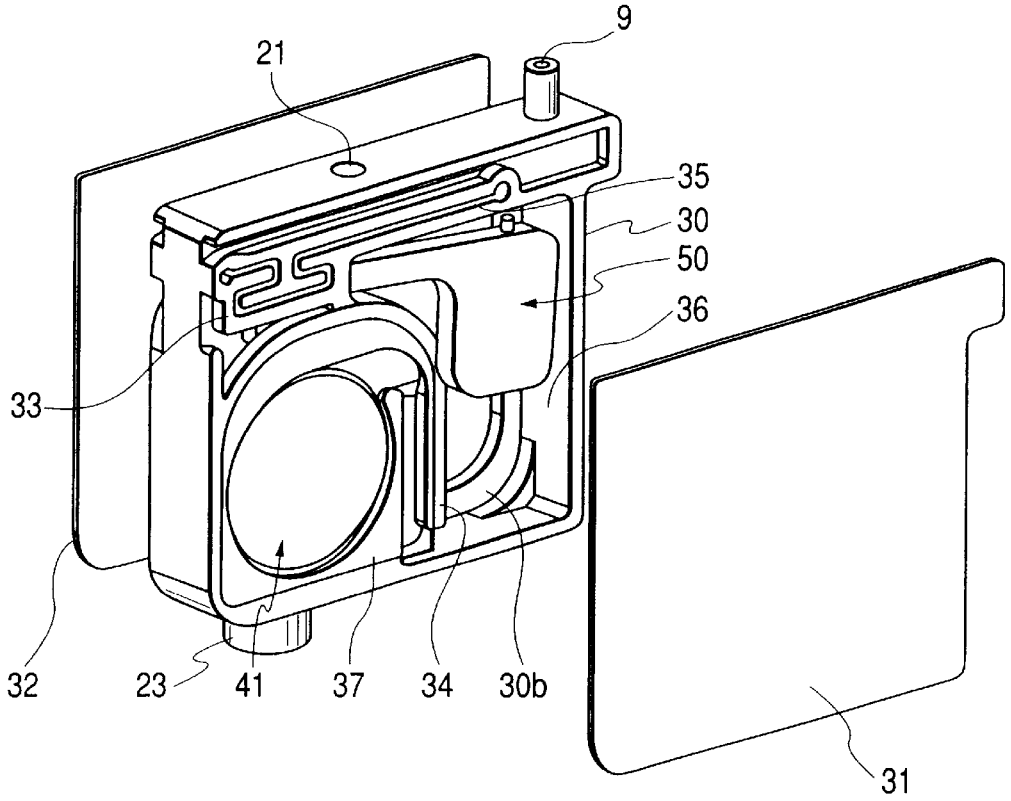
FIGS. 3A and 3B show the construction of the sub-tank when viewed from the front and rear while a sealing film is removed or omitted from the sub-tank.
Figure 3B:
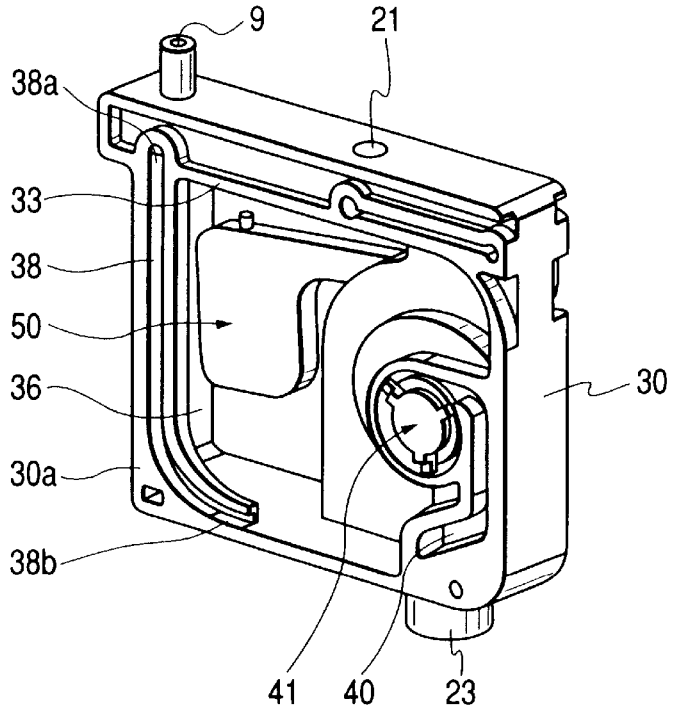

As can be seen from FIG. 4, the case 30 is separated vertically by a wall 33 and laterally by a wall 34 to define three portions; an upper portion, alower left-side portion, and a lower right-side portion. A narrow channel 35 is in the upper portion defined by the wall 33 for establishing communication with the atmosphere. The lower left-side portion serves as an ink storage chamber 36, and the lower right-side portion serves as a valve chamber 37. A thick section 30*b* extends along a side surface 30*a* of the ink storage chamber 36 to a bottom thereof. An ink supply channel 38 is formed in the thick section 30*b*. An upper end 38*a* of the ink supply channel 38 is connected to the ink inlet port 9, and a lower end 38*b* is in communication with the bottom of the ink storage chamber 36.

The air release port 21 is in communication with an upper portion of the ink storage chamber 36 via a communication hole 21*a* formed in the casing 30, the narrow channel 35 formed in the wall 33, etc. A differential pressure regulating valve mechanism 41 is accommodated in the valve chamber 37 to discharge ink from the ink storage chamber 36 through a channel 40 serving as an ink flow channel, while maintaining the recording head 4 at a given negative pressure. A float member 50 is provided within the ink storage chamber 36, and pivotally connected to a pin 52 by way of an arm 51. When the ink storage chamber 36 is filled up, the float member 50 is held in a substantially horizontal position. An indicator 53 of a small magnetic piece, such as a permanent magnet, is provided at aposition on the surface of the float member 50 located close to outer side of the casing 30.

First and second magnetic-field detection systems 54 and 55 are arranged vertically in an area where the detection systems 54 and 55 can detect the magnetic flux developing in the indicator 53 through the casing 30. In the present embodiment, Hall elements are fixed on the exterior wall of the sub-tank 3 or the carriage 1.

Figure 5:
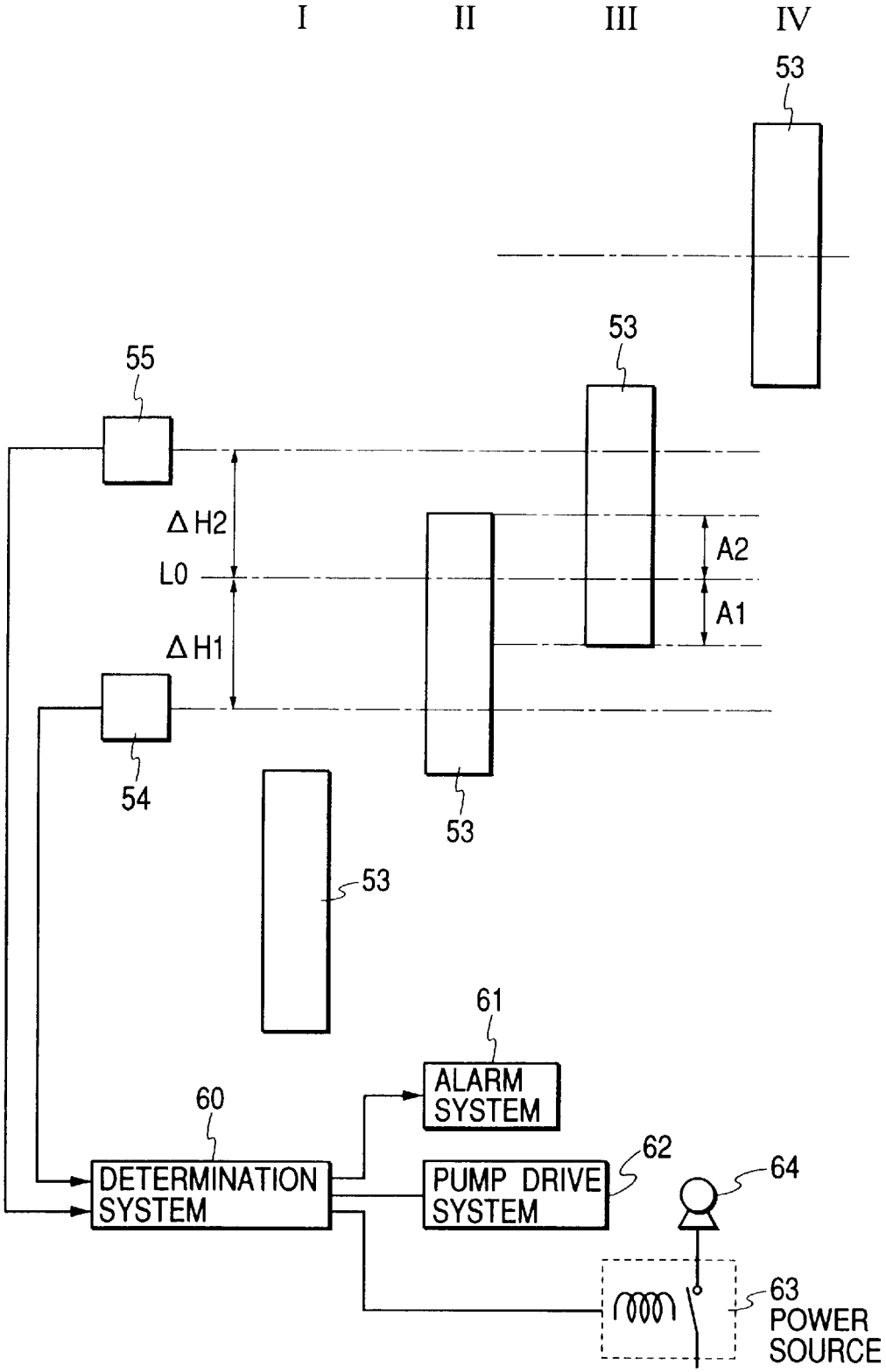
FIG. 5 is a schematic diagram showing an example of an ink supply controller for controlling supply of ink to the sub-tank, in conjunction with a level detection operation.

As shown in FIG. 5, the magnetic-field detection systems 53 and 54 are spaced apart from each other by $\Delta H1+\Delta H2$ with reference to a specified ink level L0 so that the systems 53 and 54 simultaneously detect the magnetic flux of the indicator 53 when the indicator 53 is located within a predetermined range, i.e. the level of the ink stored in the sub-tank 3 is within a predetermined range A in which the ink level is to be maintained.

In a case where the float member 50 has been moved downwardly from the position corresponding to the specific ink level L0 by $\Delta A1$ or more, the magnetic flux of the indicator 53 does not act on the upper magnetic detection system 55, thereby detecting a state that the ink level is lowered to a level at which the sub-tank 3 must be replenished with ink. On the other hand, in a case where the float member 50 has been moved upwardly from the position corresponding to the specific ink level L0 by $\Delta A2$ or more, the magnetic flux of the indicator 53 does not act on the lower magnetic-field detection system 54, thereby detecting a state that the ink level has reached an ink level at which replenishment of ink must be stopped.

Figure 6:
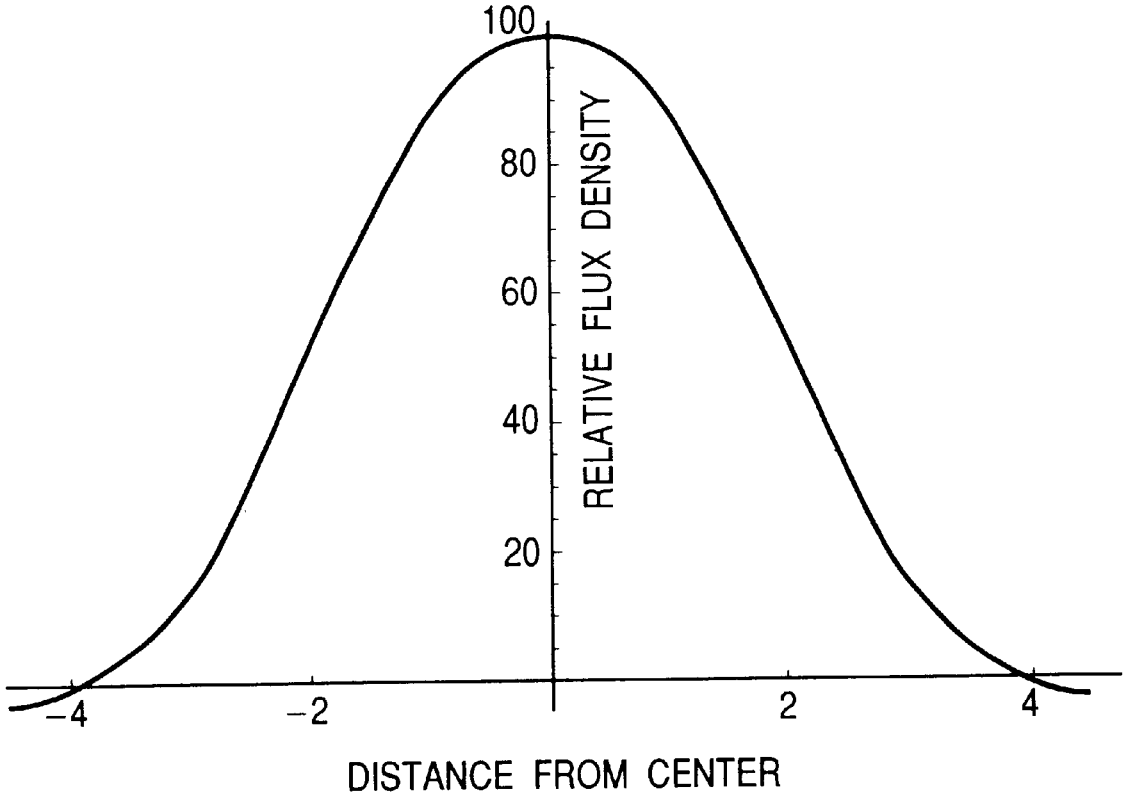
FIG. 6 is a diagram showing an example of distribution of magnetic flux developing in the indicator provided to a built-in float member of the sub-tank.

The magnetic flux distribution (see FIG. 6) of the indicator 53, the sensitivities of the magnetic-field detection systems 54 and 55 and the interval between the magnetic-field detection system 54 and 55; that is, $\Delta H1+\Delta H2$, are adjusted such that the magnetic flux of the indicator 53 simultaneously acts on the two magnetic-field detection systems 54 and 55 when the ink level is within the range of $\Delta A1+\Delta A2$ in which the ink level is to be maintained.

The range $\Delta A1+\Delta A2$ in which the ink level is to be maintained becomes narrower when the interval between the magnetic-field detection systems 54 and 55 is increased. In contrast, when the interval between the magnetic-field detection systems 54 and 55 is decreased, the range $\Delta A1+\Delta A2$ in which the ink level is to be maintained becomes wider.

A protuberance 56 is formed on the upper surface of the float member 50 for defining the upper limit position of the float member 50 regardless of an increase in ink level. The protuberance 56 comes into contact with the upper surface of the sub-tank 3; that is, the lower surface of the wall 33 in the present embodiment, thereby limiting the upper limit position of the float member 50. In this way, movement of the float member 50 outside the detection range of the magnetic detection system 55 is restricted.

In the present embodiment, the protuberance 56 is formed on the float member 50 for limiting the upper limit position.

A similar effect can be obtained even when the protuberance 56 is formed at a position on the casing 30 of the sub-tank 3 opposite the upper surface of the float member 50.

In a case where the first and second magnetic-field detection systems 54 and 55 both output L signals, as shown in Table 1, a determination circuit 60 which receives signals output from the magnetic-field detection system 54 and 55 determines that ink is at an excessively low level and outputs a first error signal. Here, L signal means that a magnetic detection system does not detect a magnetic flux; whereas H signal mean that a magnetic detection system detects a magnetic flux. In a case where only the lower first magnetic-field detection system 54 outputs an H signal, the determination circuit 60 outputs an injection start signal. In a case where the first and second magnetic-field detection systems 54 and 55 both output H signals, the determination circuit 60 determines that the ink level is maintained in an appropriate range and outputs an injection stop signal. In a case where only the upper second magnetic-field detection system 55 outputs an H signal, the determination circuit 60 determines that ink is excessively supplied to the sub-tank 3 and outputs a second error signal.

TABLE 1

| Status | 1st Magnetic Sensor | 2nd Magnetic Sensor | Determination |
|---|---|---|---|
| I | L | L | First Error Signal |
| II | H | L | Injection Start Signal |
| III | H | H | Injection Stop Signal |
| IV | L | H | Second Error Signal |

The first error signal output from the determination system 60 is delivered to alarm system 61. The injection start signal and the injection stop signal output from the determination system 60 are delivered to a pump drive system 62. Further, the second error signal output from the determination system 60 is delivered to a forced shout-down system 63. In the present embodiment, the second error signal is delivered to a switch used for supplying drive power to a pump 64.

In the present embodiment, in a state in which the sub-tank 3 is not replenished with ink, the first and second magnetic-field detection systems 54 and 55 both output L signals. In response thereto, the determination system 60 outputs a first error signal, thereby activating the alarm system 61. Further, the carriage 1 is moved to the position corresponding to the ink replenishment unit 7, and the ink inlet port 9 of the sub-tank 3 is connected to the ink replenishment unit 7. The pump 64 of the ink replenishment unit 7 is activated.

By the activation of the pump 64, ink is injected into the ink storage chamber 36 from the ink inlet port 9. When the float member 50 is raised, the first magnetic-field detection system 54 located in a lower position receives the magnetic flux of the indicator 53. In response thereto, the determination system 60 receives an injection start signal. In this state, the sub-tank 3 is already being replenished with ink, and hence the pump drive system 62 causes the pump 64 to operate continuously, thereby continuously supplying ink.

When the sub-tank 3 is replenished with ink until the ink level reaches to a position lower than the specific ink level L0 by only ΔA1, the magnetic flux of the indicator 53 of the float member 50 acts on the first and second magnetic-field detection systems 54 and 55, whereupon the first and second magnetic-field detection systems 54 and 55 both output H signals. Upon receipt of the H signals, the determination system 60 outputs a supply stop signal to stop the pump 64.

When the sub-tank 3 is replenished with ink to a specified amount, a printing operation becomes feasible, and the ink-jet recording apparatus performs a printing operation. When the ink stored in the sub-tank 3 is decreased in association with progress of the printing operation, the float member 50 is gradually lowered, and the second magnetic-field detection system 55 located in an upper position eventually fails to detect magnetic flux (II). The determination system 60 then outputs an injection start signal.

Upon receipt of the injection start signal, the pump drive system 62 activates the pump 64 at a point in time when the carriage 1 has moved to the position corresponding to the ink replenishment unit 7. When ink ascends to the specific ink level L0, the magnetic flux of the indicator 53 of the float member 50 acts on the first and second magnetic-field detection systems 54 and 55 simultaneously. The first and second magnetic-field detection systems 54 and 55 output H signals, and the determination system 60 outputs a supply stop signal, whereupon the pump drive system 62 deactivates the pump 64.

The level of the ink stored in the sub-tank 3 is maintained so as to fall within the range extending from −ΔA1 to +Δ2 with reference to the specific ink level L0, and ink is supplied to the recording head 4 with water head pressure difference suitable for printing.

In the event that the operating state of the pump 64 is maintained because of a failure in the operation of the pump drive system 62 without regard to the fact that the determination system 60 has output an injection stop signal during replenishment of the ink tank 3, the float member 50 is raised to the top dead point defined by the protuberance 56 (IV). In this state, the first magnetic-field detection system 54 outputs an L signal, and the second magnetic-field detection system 55 outputs an H signal. The determination system 50 outputs a second error signal to the forced shut-down system 63, whereupon power supplied to the pump 64 is disconnected and ink replenishment is forcefully stopped, thus preventing occurrence of an overflow.

Even if ink has been injected to an amount greater than the specified amount, the float member 50 is held in the predetermined upper limit position by means of the protuberance 56. Hence, the magnetic flux of the indictor 53 acts on the second magnetic-field detection system 55, thereby enabling the determination system 60 to distinguish this state from the state in which ink is in an excessively low level. In a case where the top dead point is not defined for the float member 50, the indicator 53 is moved to a position where the second magnetic detection system 55 cannot detect the magnetic flux of the indicator 53, and therefore the determination system 60 cannot determine whether the ink level is in an excessively low level or an excessively high level.

In the previous embodiment, the sub-tank 3 has a built-in negative pressure generation system for controlling the pressure of the ink supplied to the recording head 4. This is for the purpose of improving the quality of printing operation of a recording head and surely preventing leakage of ink. In a case where ink can be retained by means of a meniscus of a nozzle orifice of the recording head 4, the negative pressure generation system can be dispensed with. So long as the ink storage chamber 36 is located at aposition below the recording head 4 and ink is supplied to the recording head 4 by means of a siphon phenomenon, negative pressure caused by water head pressure difference can be maintained.

The previous embodiment has been described with reference to an example in which the sub-tanks 3 provided on the carriage 1 are intermittently moved to the position corresponding to the ink replenishment unit 7, where the sub-tanks 3 are connected to the ink replenishment unit 7, and in which, during a printing operation, the sub-tanks 3 are disconnected from the ink replenishment unit 7. However, as shown in FIG. 7, the sub-tanks 3 may be used while being connected to the ink cartridges 5 at all times by way of ink supply tubes 60.

Figure 7:
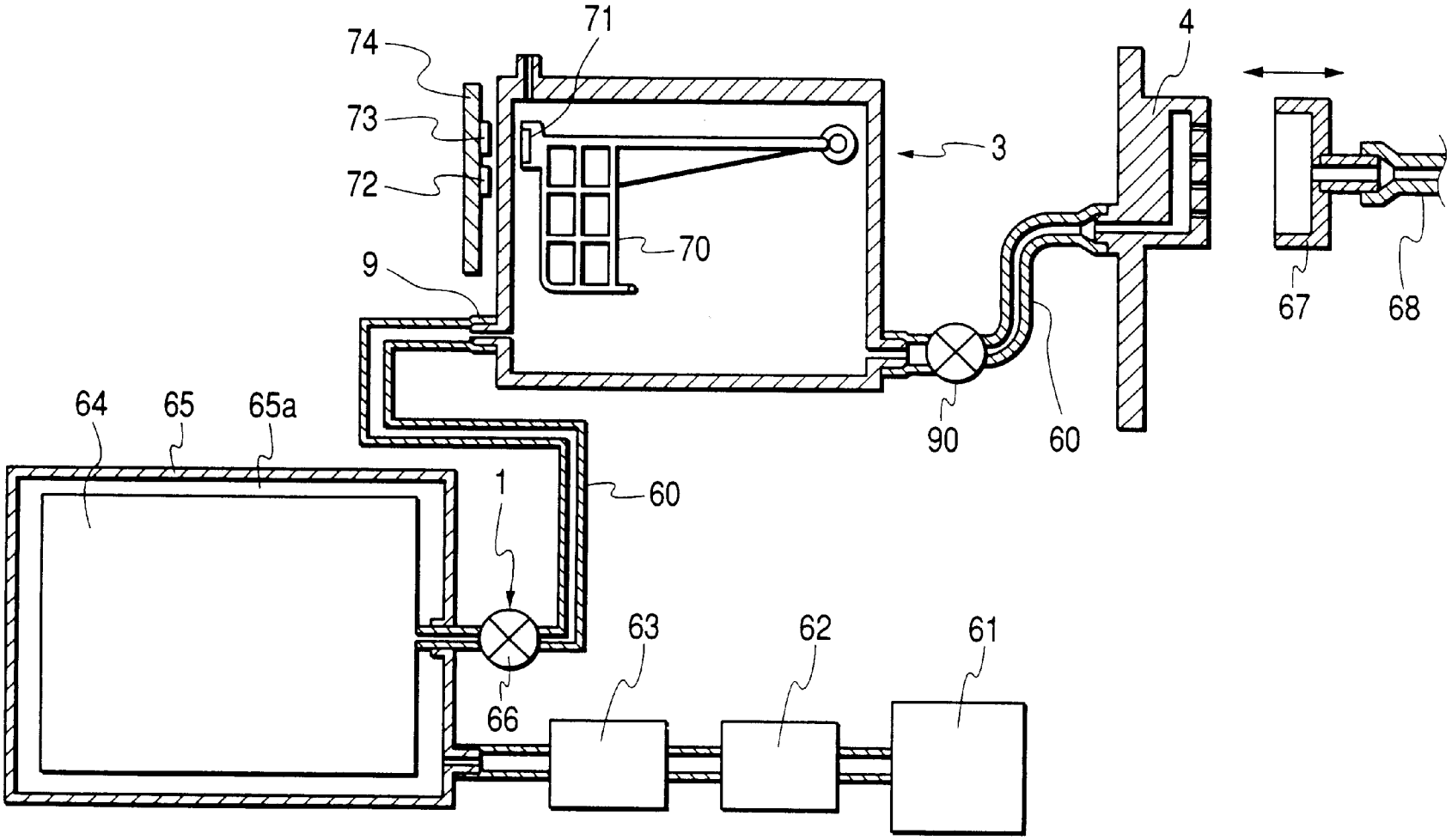
FIG. 7 is a diagram showing an example in which the present invention is applied to a recording apparatus having a sub-tank constantly connected to an ink cartridge by way of an ink supply tube.

As shown in FIG. 7, through a pressure control valve 62 and a pressure detector 63, a pressure applying pump 61 is in communication with a space 65*a* of a main tank 65 which is made of a hermetic case and houses an ink pack 64. The ink pack contains ink sealed therein, and is made of flexible material. As a result, the ink pack 64 is always held in a constantly-pressurized state in which the ink pack 64 can discharge ink. The ink pack 64 is connected to the ink inlet port 9 of the sub-tank 3 by way of a valve 66 and the tube 60. As a result, when the valve 66 is opened/closed, a predetermined amount of ink flows into the sub-tank 3 from the ink pack 64.

The sub-tank 3 has a float member 70 which is pivotally moved in association with motion of an ink level, as mentioned previously. A permanent magnet 71 constituting an indicator is provided on one side of the float member 70. Magnetic-fielddetection systems 72 and 73 are provided outside the sub-tank 3, and fixed on a substrate 74 to be arranged vertically.

With this arrangement, similarly to the aforementioned embodiment, the ink level in the sub-tank 3 is detected using the float member 70, and the magnetic-field detection systems 72 and 73 output signals, on the basis of which the valve 66 is controllingly opened or closed to maintain the ink amount in the sub-tank within a predetermined range. In FIG. 7, reference numeral 67 designates a capping system for sealing the recording head, which is connected to an unillustrated vacuum pump through a tube 68.

Figure 8:
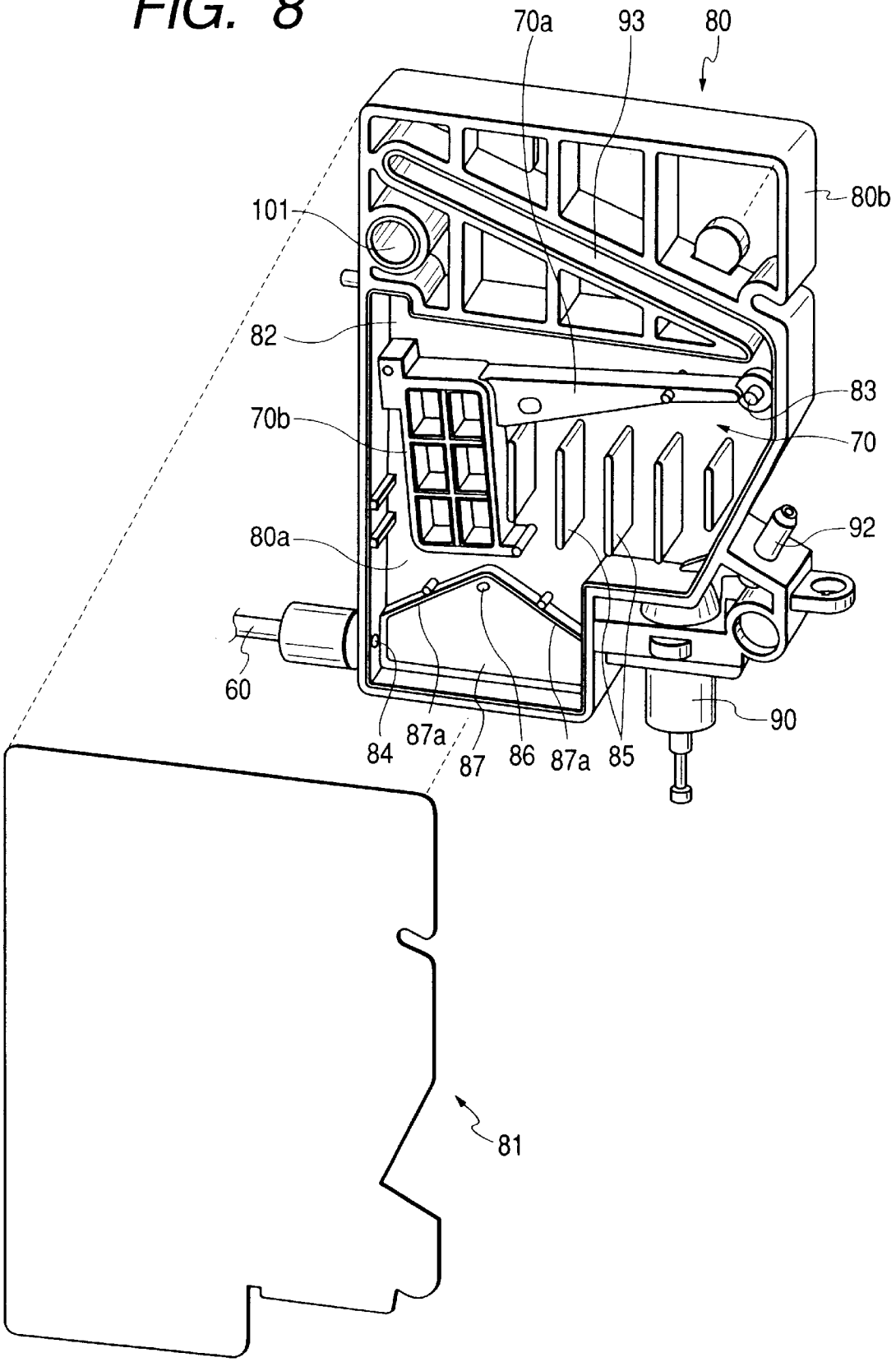
Figure 9:
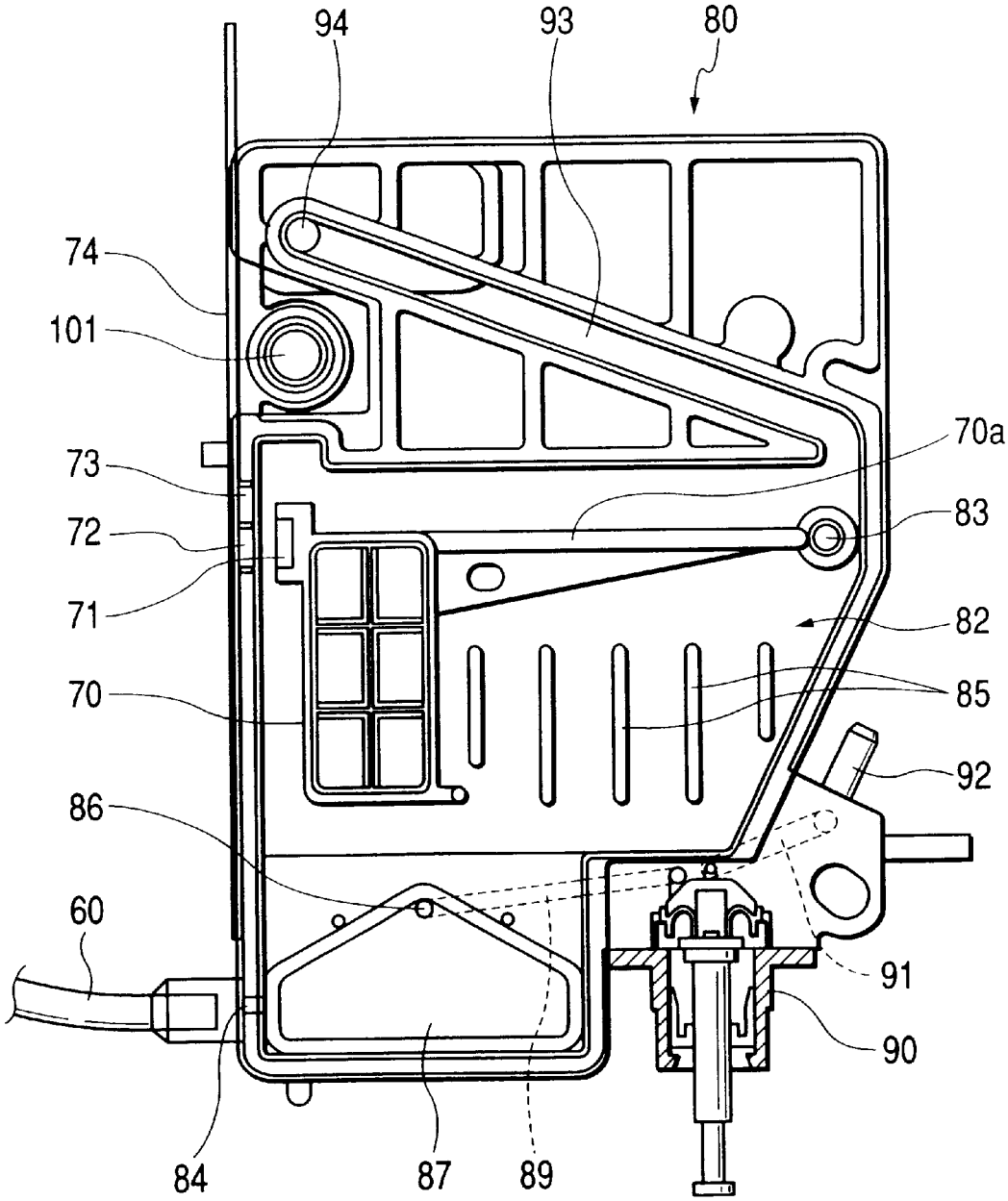
Figure 10:
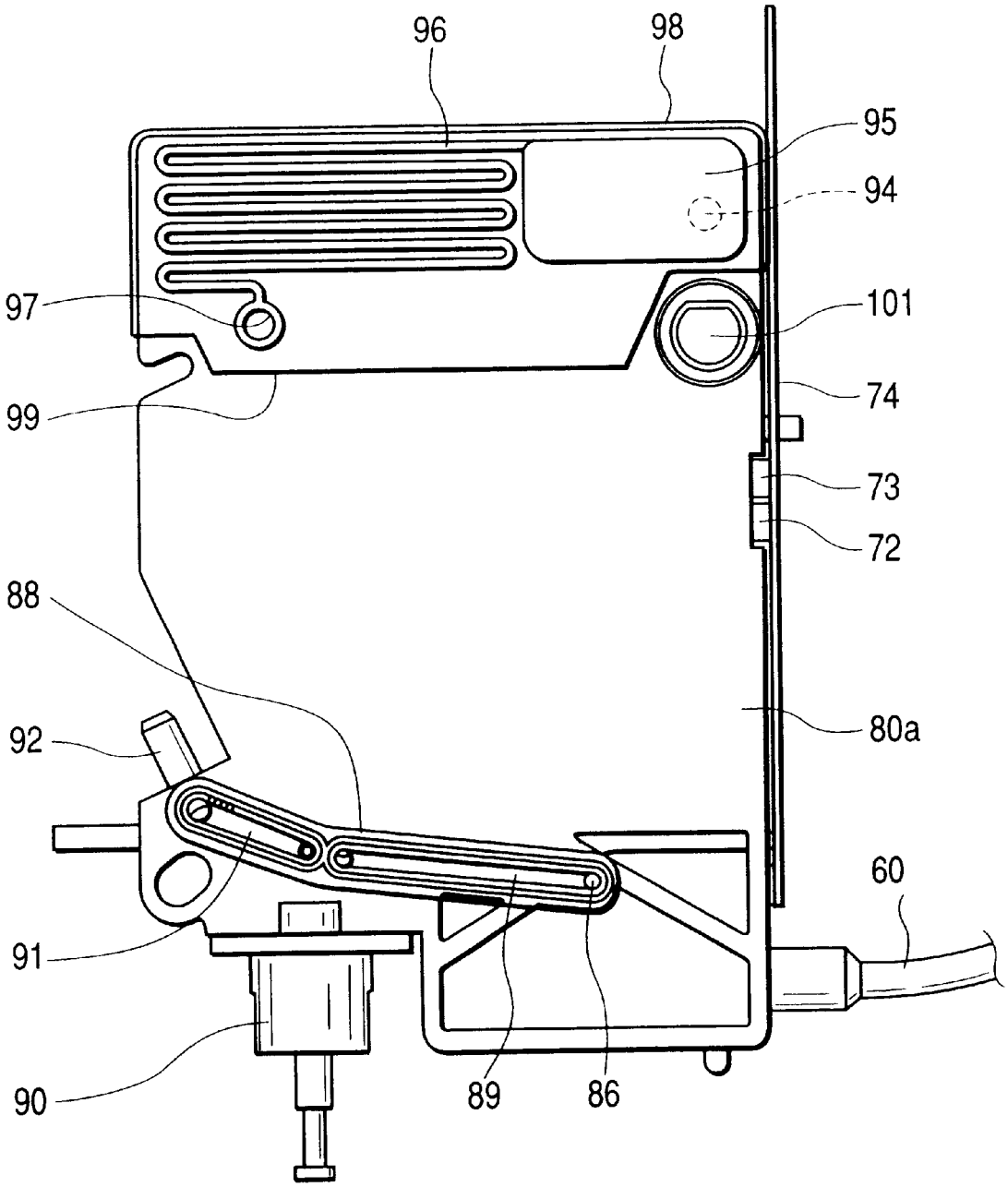

FIGS. 8 through 10 show an example of the previously-described sub-tank 3. In this example, the sub-tank 3 is constructed as a flat and substantially-rectangular-parallelepiped container. More specifically, a box-shaped member 80 having a bottom is formed as a one-piece unit having an integral side wall 80*a* and an integral peripheral wall 80*b* connected thereto. The open side of the box-shaped member 80 is sealed with a film member 81. The film member 81 and the box-shaped member 80 are made of polymeric material. The film member 81 is attached to the periphery of the box-shaped member 80 by means of thermal welding. An ink storage chamber 82 is formed in a lower area of the box-shaped member 80.

A support pin 83 is protruded perpendicularly from the side wall 80*a* of the box-shaped member 80. An arm 70*a* of the float member 70 is pivotally attached to the support pin 83 so that the float member 70 can vertically pivot about the support pin 83 in accordance with the amount of the ink stored in the ink storage chamber 82.

A permanent magnet 71 serving as the indicator is fixed on a surface 70*b* opposite from the arm 70*a* of the float member 70. When the arm 70*a* is in a substantially horizontal position, the permanent magnet 71 is situated at a position between the magnetic-field detection systems 72 and 73.

An ink replenishment port 84 is formed at a position in the vicinity of the bottom portion of the peripheral side wall 80*b* of the box-shaped member 80, so that ink is supplied to the bottom portion of the ink storage chamber 82 from the ink cartridge 5, which serves as a main tank, by way of the tube 60. Since ink flows into the bottom portion of the ink storage chamber 82, ink can be supplied to the ink storage chamber 82 while preventing bubbling of ink.

A plurality of vertically extending ribs 85 are projectingly provided to the box-shaped member 80 in an area where the ribs 85 confront with but do not interfere with the float member 70 including the arm 70*a*. The ribs 85 may be formed integrally with the box-shaped member 80, or may be separate members attached to the box-shaped member 80. The ribs 85 can prevent occurrence of wavy motion or bubbling of ink, which would otherwise be caused by reciprocating motion of the carriage 1. The ribs 85 also serves to allow the floating member 70 to be moved correspondingly to the amount of ink, thereby contributing to highly accurate detection of ink amount.

An ink outlet port 86 is formed in the vicinity of the ink replenishment port 84. A polygonal filter member (a filter member 87 having upper slopes 87*a* connected together at an apex, in this embodiment) is provided to cover the ink outlet port 86. With this arrangement, immediately after ink flows from the ink pack, the ink can be passed through the filter member 87 and supplied to the recording head.

Since the ink outlet port 86 is located in the vicinity of the apex of the filter member 87, air bubbles which have reached an area in the vicinity of the ink outlet port 86 side of the filter member 87 are moved to the ink outlet port 86 along the slopes 87*a*. Accordingly, if ink is forcefully discharged from the recording head 4 using the capping system 67, these air bubbles are readily sucked through the ink outlet port 86 and discharged outside the ink supply system.

The ink outlet port 86 is formed to penetrate through the side wall 80*a* of the box-shaped member 80. The ink outlet port 86 is communicated, through a groove 89 of an ink guide member 88 on the surface of the box-shaped member 80, with an inlet port of a valve 90 provided in the lower surface of the box-shaped member 80. Further, the ink outlet port 86 is communicated through an outlet port of the valve 90 and a groove 91 of the ink guide member 88 with a connect port 92 to which a tube connected to the recording head 4 is connected. The grooves 89 and 91 are sealed by an unillustrated member, such as a film, thus serving as flow channels.

An inclined communication groove 93 is formed in an upper portion of the sub-tank 3 so as to be communicated with the ink storage chamber 82. The upper end of the communication groove 93 is connected to an atmosphere communication port 94 penetrating through the side wall 80*a* of the sub-tank 3. The atmosphere communication port 94 is communicated, through an upper portion of a recess 95 having a relatively large volume to serve as an ink reservoir, with one end of a meandering groove 96 formed on the surface of the box-shaped member 80. The other end of the meandering groove 96 is in communication with a recess 97 of such a size as to permit insertion of a jig.

The recess 95 is sealed by a water-repellent film 98. Further, the meandering groove 96 and the recess 97 are sealed by an air blockage film 99 that partially overlaps the film 98.

With this arrangement, the atmosphere communication port 94 is sealed by the film 99 when the sub-tank 3 is not in use. Hence, after completion of assembly of the sub-tank 3, the sub-tank 3 can be checked by means of a pressurization test. After completion of the test, a part of the film 99 located in the area of the recess 97 is broken or opened using a jig or the like so that the ink storage chamber 82 is brought in communication with the atmosphere. In a state in which the ink storage chamber 82 is in communication with the atmosphere, even if ink in the ink storage chamber 82 flows out through the communication groove 93, the ink will be captured by the recess 95. The water repellent characteristic of the film 98 sealing the recess 95 prevents flow of ink into the meandering groove 96. Accordingly outflow of ink is prevented.

Figure 11:
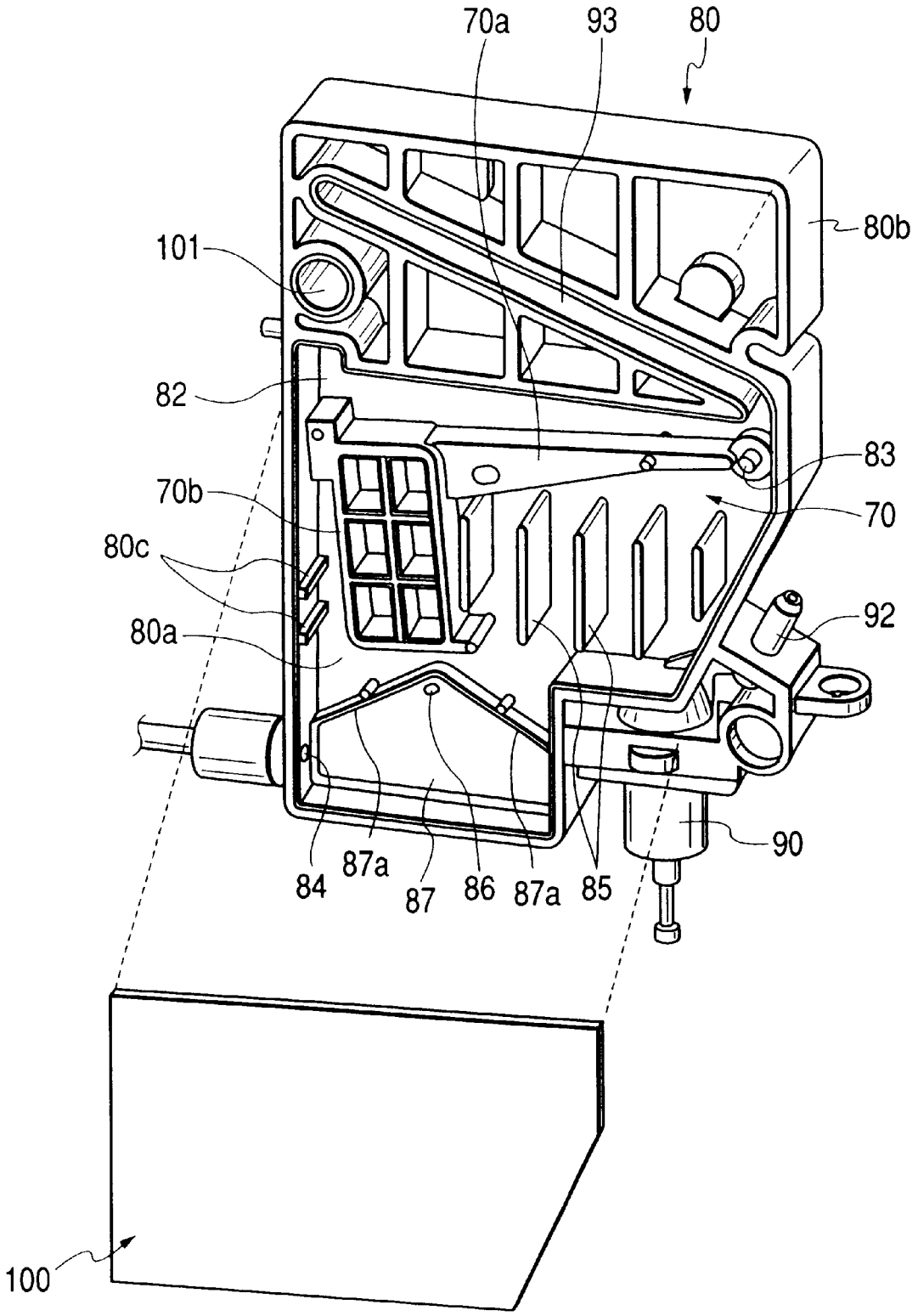
FIG. 11 is a perspective view showing still another example of the sub-tank.

FIG. 11 shows still another example of the sub-tank 3. A reinforcement member 100 formed from, for example, a stainless plate or a plastic plate identical in material with the box-shaped member 80 is attached to an area of the ink storage chamber 82 in which the film member 81 has been provided in the previous example. The reinforcement member 100 is fixed to ensure a space between the float member 70 and the reinforcement member 100 by ribs 80*c* formed on the interior side surface of the peripheral wall 80*b* of the box-shaped member 80 so as not to hinder motion of the float member 70.

The reinforcement member 100 prevents deformation of the film member 81, which would otherwise be caused by a variation in ink pressure caused when the ink storage chamber 82 is replenished with ink or when the ink stored in the storage chamber 82 is consumed. That is, the reinforcing member 100 contributes to the reliable follow-up motion of the float member 70 depending on an ink level and highly-accurate detection of an ink level in the sub-tank 3.

The reinforcement member 100 prevents evaporation of ink solvent in cooperation with the filmmember 81, thereby preventing an increase in the viscosity of ink. When the film member 81 is attached to the box-shaped member 80 by thermal welding, the reinforcement member 100 protects the ink level detection system, such as the float member 70, which has already been installed in the ink storage chamber 82, from heat of thermal welding.

Figure 17:
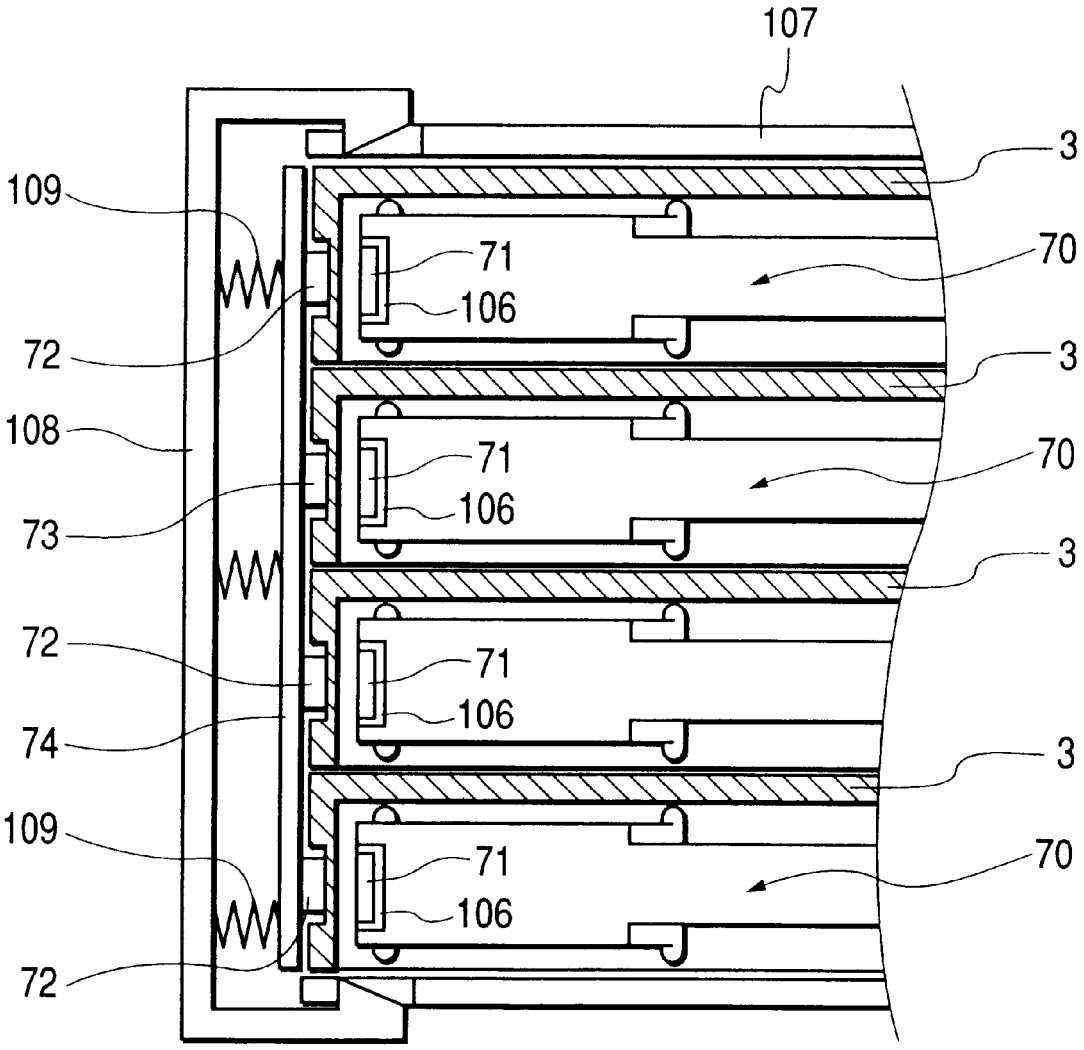
FIG. 17 is a diagram showing an example in which a plurality of sub-tanks are employed as a unit.

As shown in FIG. 17, different types of ink are stored in respective sub-tanks 3, and the sub-tanks 3 are stacked in the thickness direction thereof to constitute a sub-tank unit. The sub-tank unit is mounted to a carriage. If a through hole 101 is formed in an area of each sub-tank 3 where the through hole 101 will not affect the airtightness of the ink storage chamber 82 (in this embodiment, a through hole 101 is formed at an upper portion of the sub-tank 3), a sub-tank unit can be readily constructed by inserting a rod-shaped support into the through holes 101 formed in a plurality of sub-tanks 3.

Figure 12A:
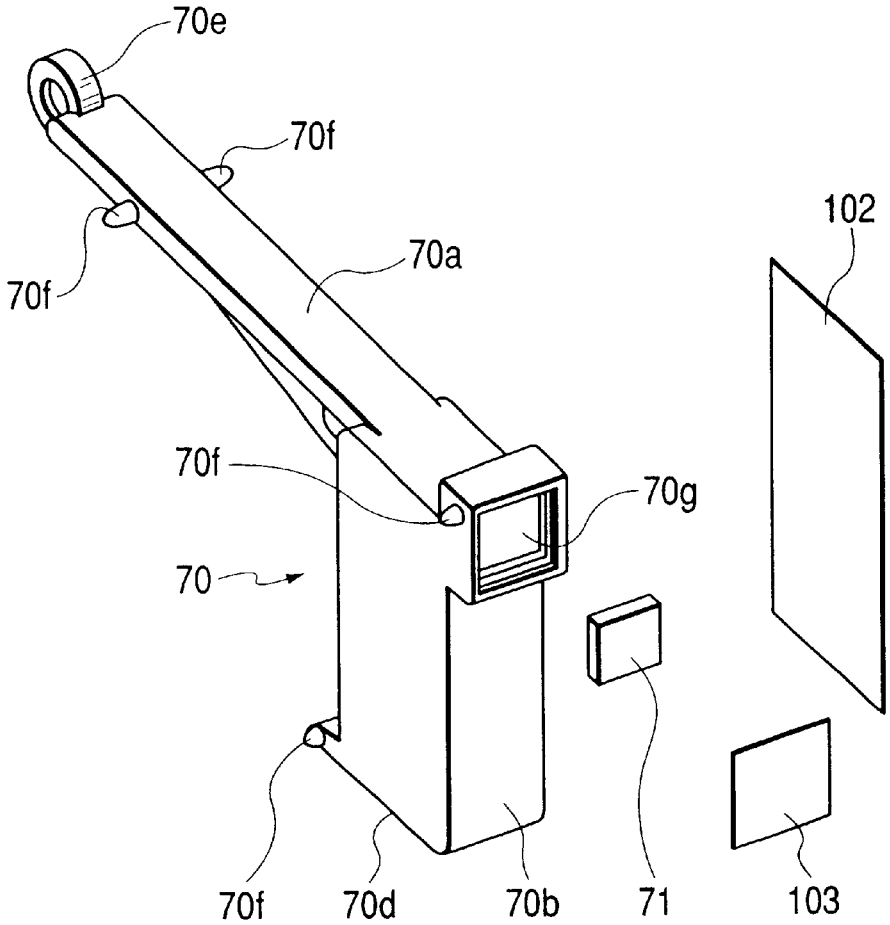
FIG. 12A is an exploded perspective view showing another example of the float member.
Figure 12B:
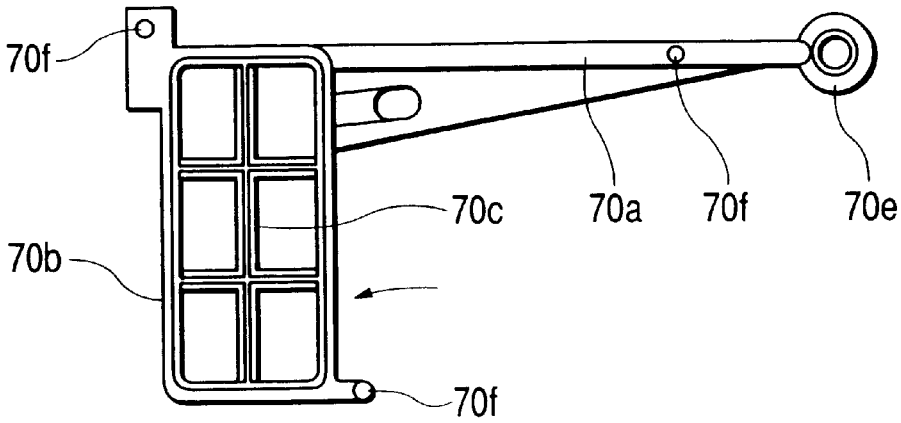
FIG. 12B is an illustration showing the construction of an opening of the float member shown in FIG. 12A.

As shown in FIG. 12B, a grid-pattern rib 70*c* is formed in a container section 70*d* of the float member 70. One side of the container section 70*d* is opened, and the container section 70*d* is integrally formed with one end of an arm 70*a*. A film member 102 is attached to the open side of the container section 70*d* by thermal welding so that a float is formed. A through hole 70*e* to be pivotally engaged with the support pin 83 is provided on the other end of the arm 70*a*. Protuberances 70*f* are provided at required positions on both sides of the container section 70*d* and the arm 70*a* in the thickness direction in order to ensure a clearance between the float member 70 and the box-shaped member 80, the film member 81 or the reinforcement member 100 to such an extent that a capillary phenomenon does not arise in the clearance. This arrangement prevents ink accumulation caused by surface tension between the box-shaped member 80, the film member 81 or the reinforcement member 100, and the float member 70. That is, it is possible to prevent the float member from being hindered or shifted by the ink accumulation. A protuberance (corresponding to the protuberance indicated by 56 in FIG. 4) is provided on an upper portion of a surface 70*b* of the float member 70 so as to define the upper limit position of the float member. A recess 70*g* is formed in this protuberance, a permanent magnet 71 serving as the indicator is fitted into the recess 70*g*, and an opening of the recess 70*g* is sealed with a closure member 103.

Figure 13:
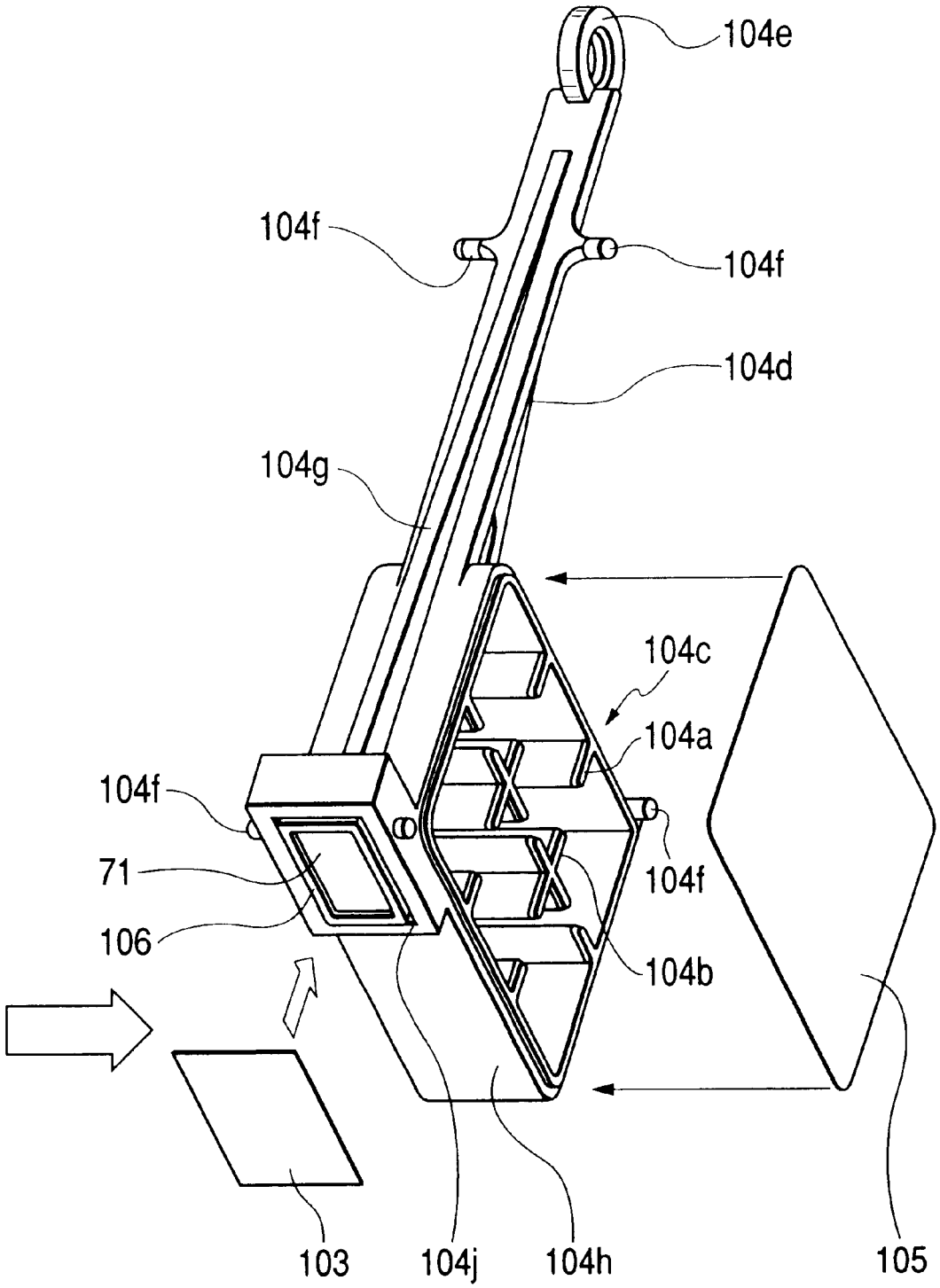
FIG. 13 is an exploded perspective view showing still another example of the float member.

FIG. 13 shows another example of the float member. The float member is provided with separate ribs 104*a* and 104*b* inside a container section 104*c*. An arm 104*d* is integrally connected to one end of the container section 104*c* having an open side. The open side of the container section 104*c* is sealed by a film member 105 so that a float is formed. A through hole 104*e* is formed at the other end of the arm 104*d*. The through hole 104*e* is pivotally connected to the support pin 83. Protuberances 104*f* are provided at required positions on both sides of the container section 104C and the arm 104*d* in the thickness direction. The protuberances 104*f* contact the box-shaped member 80, the film member 81 or the reinforcement member 100 with less friction in order to prevent shifting of the float member. In the present embodiment, a reinforcement rib 104*g* is formed on the upper surface of the arm 104*d* so as to extend to the container section 104*c*.

Figure 14A:
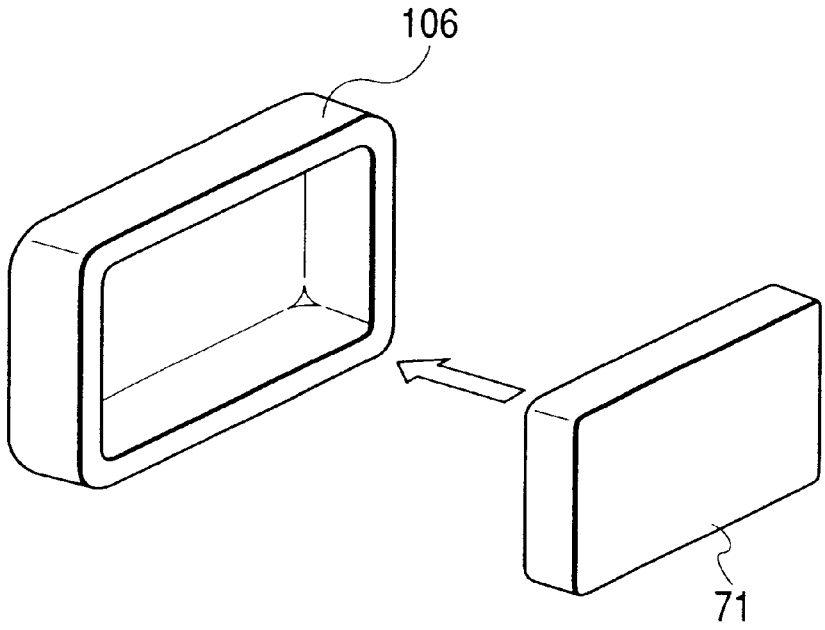
FIGS. 14A and 14B are perspective views showing an embodiment of a construction for mounting a permanent magnet on the float member.
Figure 14B:
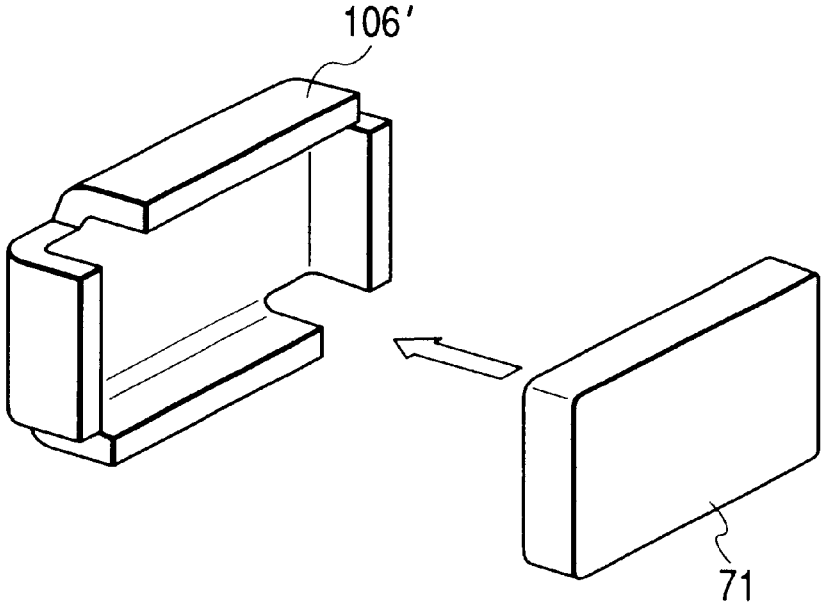

A recess 104*j* is formed in an upper portion of a surface 104*h* of the container sect on 104*c*. A rectangular-parallelepiped permanent magnet 71 with a magnetic back yoke 106 or 106' is fitted into the recess 104*j* such that the longitudinal direction of the magnet 71 is oriented vertically; i.e., in the direction in which the float member 104 is to be moved. The magnetic back yoke 106 as shown in FIG. 14A is formed as such a box shape that a surface of the magnetic back yoke 106 to be opposed to the magnetic detection system is open. The magnetic back yoke 106' as shown in FIG. 14B is formed by bending side edges of a plate. The opening of the recess 104*j* is sealed by the closure member 103.

In the present embodiment, the volume of the ribs 104*a* and 104*b* of the container section 104*c* is small, and hence the container section 104*c* generates greater buoyant force than that generated by the container section shown in FIGS. 12A and 12B. Accordingly, the container section 104*c* can cancel a drop in floating characteristic of the float member due to the mass of the back yoke 106 or 106'.

Figure 15:
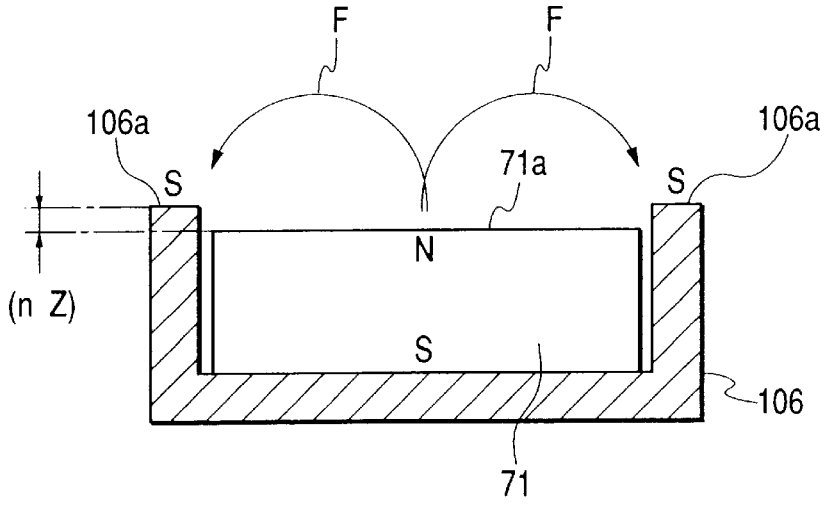
FIG. 15 is an illustration showing the positional relationship between the permanent magnet and a back yoke.

The back yokes 106 and 106' are formed such that ferrite plate or silicon steel plate, which have great relative magnetic permeability and are less likely to cause magnetic saturation, is subjected to drawing or bending process. As shown in FIG. 15, when the permanent magnet 71 magnetized in its thickness direction is mounted to the back yoke 106, the magnetic resistance is reduced by the back yoke 106, so that a magnetic flux F of the permanent magnet 71 returns to the opening end 106*a* of the back yoke 106. Consequently, leaking magnetic flux is significantly reduced.

As shown in FIG. 15, it is preferable to set the distance nZ between the surface 71*a* of the permanent magnet 71 and an imaginary line extending across the open end of the back yoke 106 to be in a range of 0.0 to 0.5 mm.

In a case where the distance nZ is less than 0.0 mm (i.e., a case where the surface 71*a* of the permanent magnet 71 protrudes from the open end 106*a* of the back yoke 106), a portion of the magnetic flux from the permanent magnet 71 passes outside the end section 106*a* of the back yoke 106. Thus, the quantity of magnetic force lines, leaking in the lateral end direction, becomes greater. In a case where nZ exceeds a value of 0.5 mm, the majority of magnetic force lines F from the N pole run to the open end 106*a* of the back yoke 106 along the shortest distance. Accordingly, the amount of magnetic flux acting on the magnetic-field detection systems 72 and 73 becomes smaller, thus deteriorating the detection sensitivity or accuracy of the magnetic detection systems 72 and 73.

Figure 16:
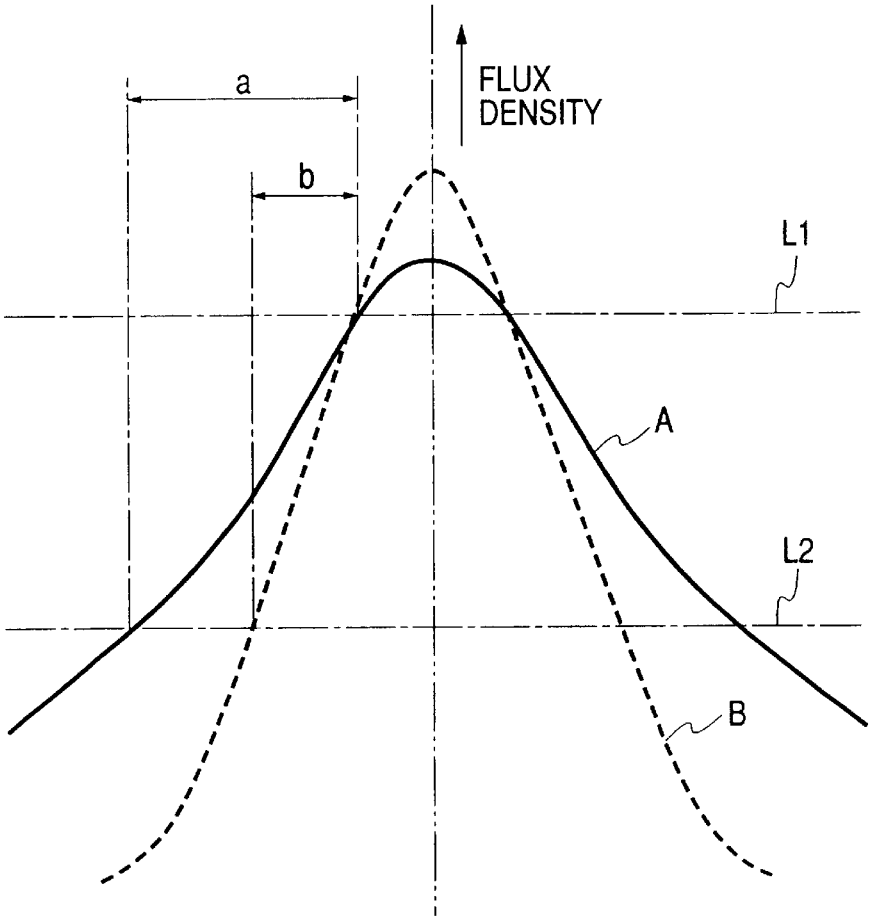
FIG. 16 is a diagram showing the distribution of magnetic flux developing in a single permanent magnet and the distribution of magnetic flux developing in a permanent magnet equipped with a back yoke.

FIG. 16 shows the above-described phenomena. Characteristic curve B shows the distribution of magnetic flux at a position opposite the N pole of the permanent magnet 71 equipped with the back yoke 106 (for example, in a detectable region of the magnetic detection system). Further, characteristic curve A shows the distribution of magnetic flux by a single permanent magnet which does not have a back yoke. As can be seen from the curves, the back yoke 106 can focus the magnetic flux of the permanent magnet 71 in the direction of the normal to the surface 71*a* of the permanent magnet 71. Thus, the back yoke 106 can substantively reduce variations in detection width associated with variations of the magnetic detection system. Since the magnetic flux of the permanent magnet 71 can be effectively utilized for detecting an ink level, the indicator can be constructed by a smaller permanent magnet, thereby making the float member 104 compact in size.

Thus, the magnetic flux is focused by the back yoke 106 or 106', and the longitudinal direction of the permanent magnet 71 is oriented vertically. Further, the back yokes 106 and 106' are formed so as to correspond to the geometry of the permanent magnet 71. Therefore, in a case where a plurality of sub-tanks 3 are housed in the case 107 as a unit, as shown in FIG. 17, it is possible to effectively suppress faulty operation of the magnetic-field detection systems 72 and 73 caused by magnetic flux leaking from the permanent magnet 71 of an adjacent sub-tank 3, and influence of magnetic attractive force or repulsive force exerted on the float members 104 of the adjacent sub-tanks 3. In the drawing, reference numeral 108 designates a clamp bar for pressing a substrate 74 having the magnetic detection systems 72 and 73 mounted thereon against the sub-tanks 3 through springs 109.

Figure 18:
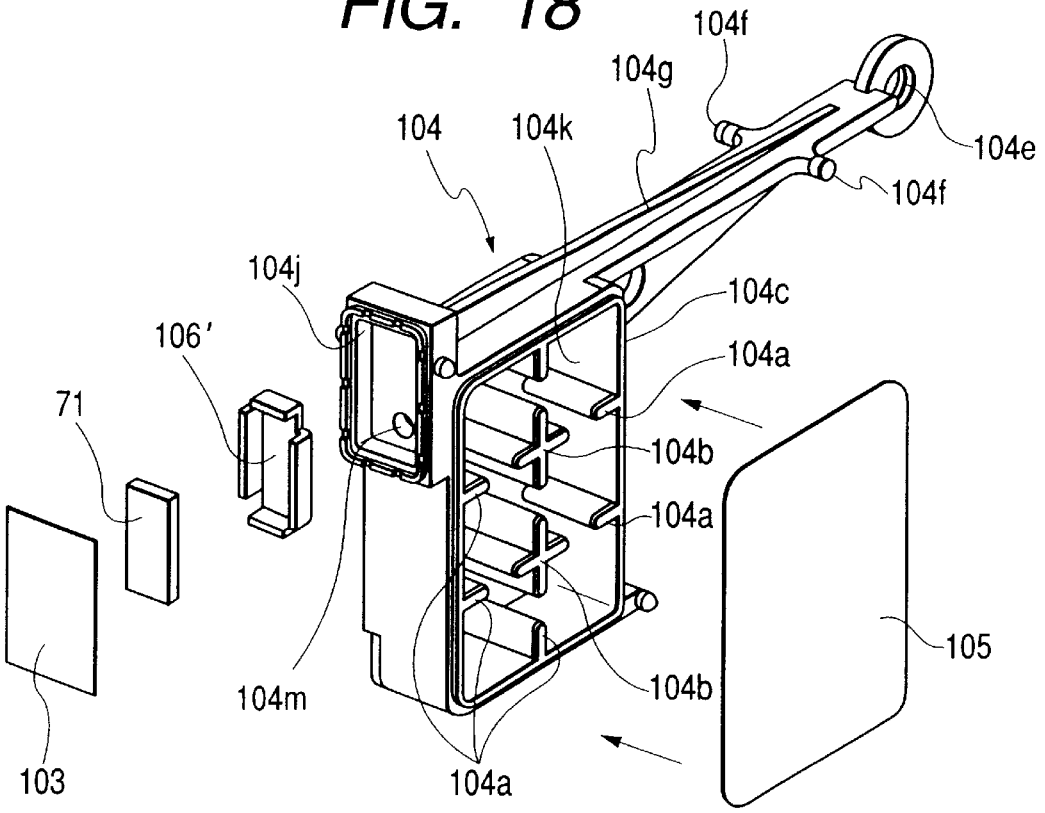
FIG. 18 is a perspective view showing yet another example of the float member.
Figure 19:
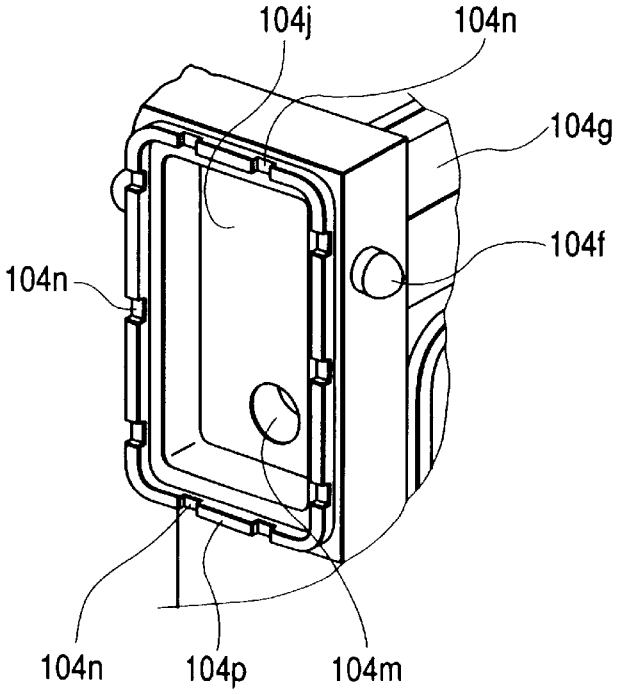
FIG. 19 is an enlarged view showing the back yoke.
Figure 20:
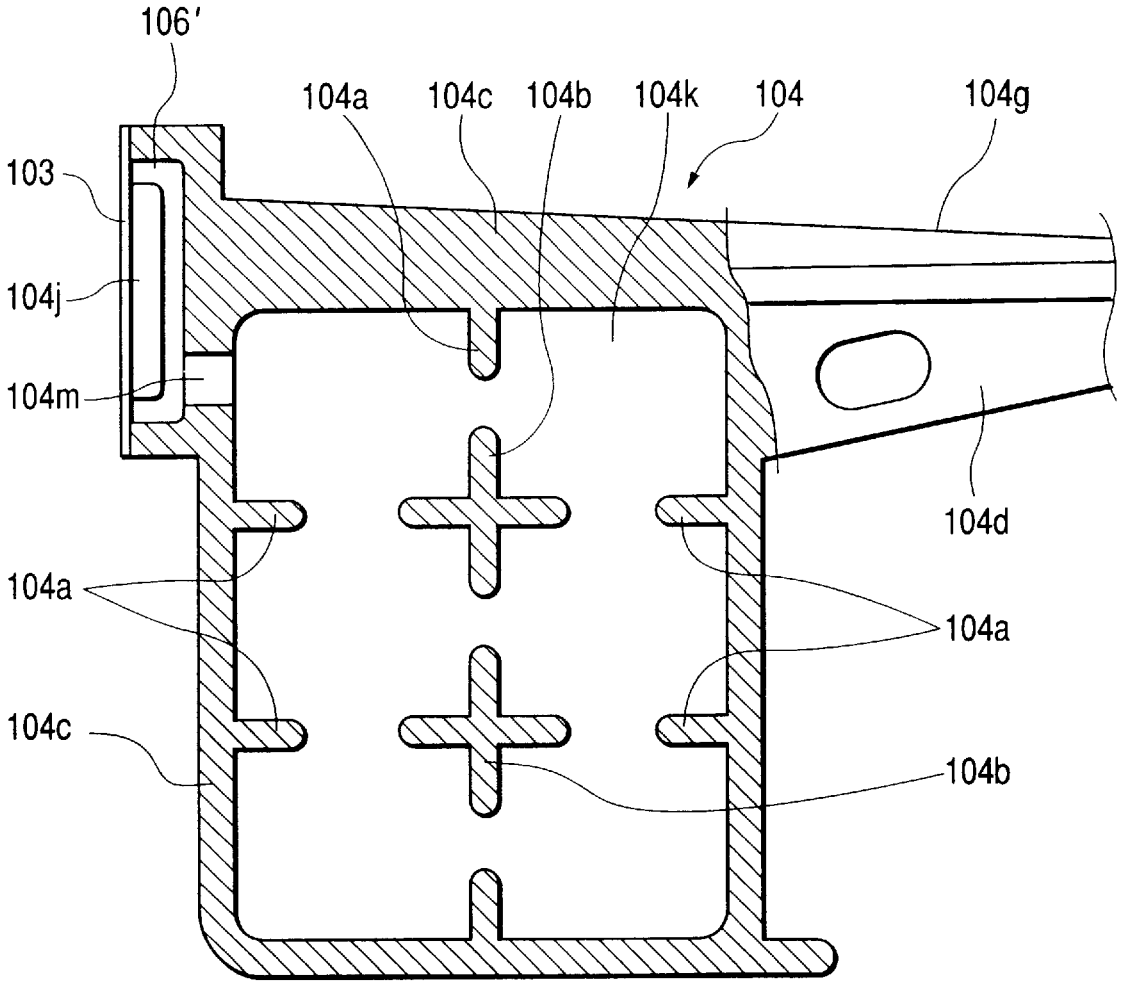
FIG. 20 is an enlarged cross-sectional view showing a container section constituting the float member.

FIGS. 18 through 20 show an example which is suitable for a case where a float chamber of the float member and an ink storage chamber are defined by thermally welding soft cover members, such as films, to respective recess portions. A recess 104*j* for accommodating the back yoke 106 and the permanent magnet 107 therein is formed with a through hole 104*m* which is communicated with a space 104*k* constituting the float chamber. An annular rib 104*p* having at least one groove 104*n* is provided around the recess 104*j*.

Even when an opening of the space 104*k* constituting a float chamber is sealed by the film member 105 by means of thermal welding, the air in the space 104*k* which has expanded by the heat of thermal welding escapes from the through hole 104*m* to the atmosphere, so that the lid member, i.e. the film member 105, can be attached to the float member 104 while being kept flat.

After thermal welding of the lid member (the filmmember 105), the back yoke 106 and the permanent magnet 71 are fitted into the recess 104*j*. When the annular rib 104*p* of the recess 104*j* is sealed by the closure member 103 by means of thermal welding, the expanded air escapes from the groove 104*n* to the atmosphere. Accordingly, the closure member 103 can be attached to the opening of the recess 104*j* while being kept flat. This eliminates undesired variations in volume of the ink storage chamber, the float chamber or the like. Accordingly, an ink level and an amount of ink can be related to each other to have a specified relationship, and the buoyant force of the float member 104 can be set at a specific value, thereby enabling correct detection of ink amount.

Figure 21:
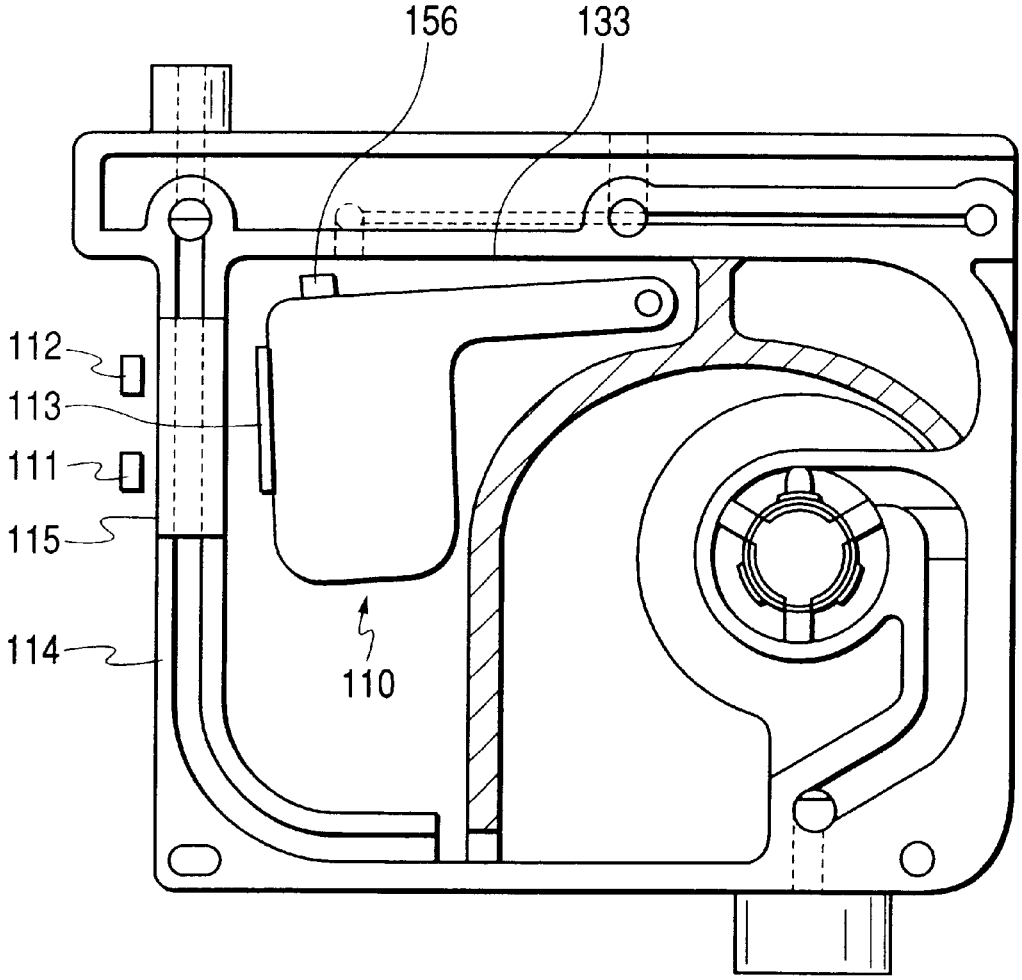
FIG. 21 is an illustration showing another example of an ink level detection mechanism suitable for use with a recording apparatus according to the present invention.

FIG. 21 shows another embodiment of an ink level detection mechanism, by taking the sub-tank 3 shown in FIG. 2 as an example. In this embodiment, an indicator 113 is provided at a position on the exterior surface of the float member 110 close to the wall surface of the container 114 such that the indicator 113 is elongated vertically and can reflect light emitted from two optical sensors 111 and 112 to be described later.

Figure 22:
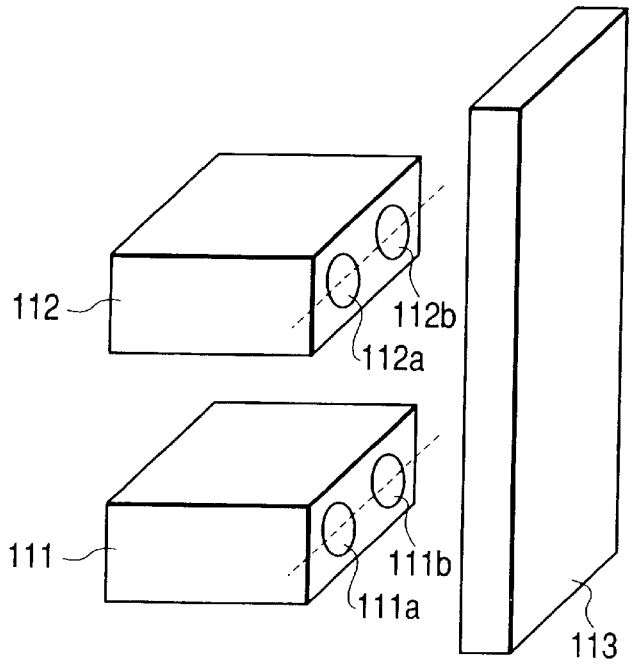
FIG. 22 shows an example of an optical sensor and an indicator which are to be used in the level detection mechanism.

A light transmissible window 115 is formed in the area of the container 114 of the sub-tank 3 where the indicator 113 is movable. The first and second optical sensors 111 and 112 are fixed on the exterior wall of the container 114 or the carriage 1 such that the first and second optical sensors 111 and 112 are arranged vertically along the window 115. As shown in FIG. 22, these optical sensors 111 and 112 are disposed so that optical paths are formed from light emitting elements 111*a* and 112*a* through the indicator 113 to light receiving elements 111*b* and 112*b* (that is, light emitted from the light-emitting element 111*a* (or 112*a*) is reflected by the indicator 113, and the thus-reflected light enters the light-receiving element 111*b* (or 112*b*)).

Figure 23:
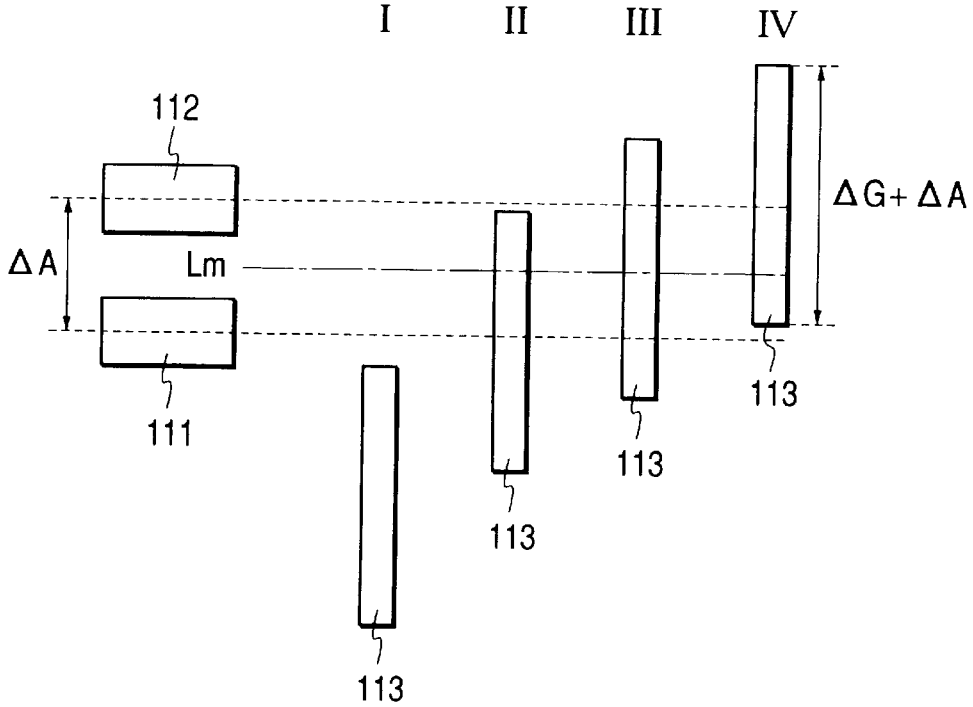
FIG. 23 is a diagram showing the operation of the ink level detection mechanism.

As shown in FIG. 23, the two optical sensors 111 and 112 are vertically spaced by predetermined interval ΔA from each other, and disposed lower and upper positions with respect to an intermediate ink level Lm. The vertical length B of the indicator 113 is set to a range of ink level to be detected; that is, the sum of a difference ΔG between the upper and lower ink levels and a difference ΔA between the sensors 111 and 112 and (ΔG+ΔA).

If ink decreases to lower the float member 110 so that the upper end of the indicator 113 is lowered to a position below the upper optical sensor 112 (FIG. 21 II), the light reflected by the indicator 113 fails to enter the upper optical sensor 112. As a result, it can be detected that the ink level has been lowered to a level at which injection of ink is required. Thus, a state in which injection of ink is required can be detected. On the other hand, when the float member 110 is raised in association with the progress of injection of ink so that the lower end of the indicator 113 is located above the lower optical sensor 111 (FIG. 23 IV), light fails to enter the lower optical sensor 111. Accordingly, it can be detected that the ink level has reached to a point at which injection of ink must be stopped; that is, a state in which injection of ink must be stopped. Needless to say, in a case where an ink level falls within a specific range (FIG. 23 III), light enters the two optical sensors 111 and 112, thereby detecting a state in which an amount of ink stored in the ink storage chamber is maintained within an appropriate range. In a case where the ink level has been lowered to a point below the lower limit level (i.e., an excessively low state shown in FIG. 23 I), no light enters the optical sensors 111 and 112. Thus, these states can be clearly distinguished from one another. In addition, similarly to the embodiment shown in FIG. 4, it is preferable to provide the float member 110 with a protuberance 156 (see FIG. 21) for defining the upper limit position of the float member 110 in cooperation with the upper surface of the sub-tank (i.e. the lower surface of wall 133 of the sub-tank in this embodiment). This eliminates upward movement of the float member 110 beyond a range where the upper optical sensor 112 can detect the indicator 113.

In the previous two examples, the magnetic-field detection systems or the optical sensors are provided on a member differing from the sub-tank. However, a similar effect can be obtained even when the magnetic-field detection systems or the optical sensors are provided on the sub-tank. In the previous embodiments, two detection systems or sensors are employed. It is apparent that, in a case where more accurate detection of an ink level is required, three or more magnetic-field detection systems or optical sensors are provided.

What is claimed is:

1. An ink-jet recording apparatus having a recording head that is mounted to a reciprocating carriage and that receives supply of ink, the recording apparatus comprising:

an ink storage chamber into which ink is supplied from an outside of the ink storage chamber;

a float member movable to follow ink level of ink stored in the ink storage chamber;

an indicator provided to the float member; and at least two detection systems provided opposite the indicator and arranged vertically, wherein both of the two detection systems detect the indicator when an amount of the ink stored in the ink storage chamber is maintained within an appropriate range, and wherein at least three statuses of ink level are detected based on signals from the detection systems.

2. The ink-jet recording apparatus according to claim 1, wherein each of the detection systems is separable from the ink storage chamber.

3. The ink-jet recording apparatus according to claim 1, wherein the indicator includes a permanent magnet, and each of the detection system includes a magnetic-field detection system.

4. The ink-jet recording apparatus according to claim 3, wherein the permanent magnet is fixed to the float member through a back yoke formed from magnetically permeable material.

5. The ink-jet recording apparatus according to claim 4, wherein the back yoke is formed into a substantial box shape, and an opening end of the back yoke protrudes forward from a surface of the permanent magnet.

6. The ink-jet recording apparatus according to claim 5, wherein the opening end of the back yoke protrudes from the surface of the permanent magnet by 0.0 to 0.5 mm.

7. The ink-jet recording apparatus according to claim 1, wherein the indictor includes an optical reflecting member, and each of the detection systems includes a light-emitting system and a light-receiving system.

8. The ink-jet recording apparatus according to claim 1, wherein the ink storage chamber is defined by a box-shaped member having an integral side wall and an integral peripheral wall connected thereto, a rib projecting from the side wall of the box-shaped member, and a film member attached to and in close contact with a periphery of an opening of the box-shaped member and a tip end of the rib.

9. The ink-jet recording apparatus according to claim 1, wherein the float member is integrally formed on a movable free end of a support arm member which is pivotable about a support pin formed on a side wall of a sub-tank.

10. The ink-jet recording apparatus according to claim 1, wherein the float member includes a container section having an open portion at one side thereof and ribs in an interior thereof, and a film member sealing the open portion.

11. The ink-jet recording apparatus according to claim 10, wherein the ribs includes at least one rib that is located at a central region and that has a cross shape.

12. The ink-jet recording apparatus according to claim 11, wherein the cross-shaped rib is located at a central region of the container section, and spaced from a peripheral wall of the container section to define a clearance therebetween.

13. The ink-jet recording apparatus according to any one of claims 10 to 12, wherein a recess is integrally provided to the container section so that a permanent magnetic serving as the indicator is accommodated in the recess, and the recess is in communication with an interior space of the container section through a through hole.

14. The ink-jet recording apparatus according to claim 13, wherein a film member is fixedly attached to a periphery of an opening of the recess to seal the recess.

15. The ink-jet recording apparatus according to claim 14, wherein an air escape groove is formed in the periphery of the opening.

16. The ink-jet recording apparatus according to claim 13, wherein the permanent magnet with a back yoke formed from magnetically permeable material is accommodated in the recess.

* * * * *